US007000344B2

(12) United States Patent
Furlan et al.

(10) Patent No.: US 7,000,344 B2
(45) Date of Patent: Feb. 21, 2006

(54) UP-AND-DOWN DISPLAY SIGN

(76) Inventors: Christopher Furlan, 21 Well Fleet Dr., Media, PA (US) 19063; John R. Protesto, 310 Sycamore Mills Rd., Media, PA (US) 19063

( * ) Notice: Subject to any disclaimer, the term of this patent is extended or adjusted under 35 U.S.C. 154(b) by 49 days.

(21) Appl. No.: 10/405,865

(22) Filed: Apr. 2, 2003

(65) Prior Publication Data

US 2004/0194361 A1 Oct. 7, 2004

(51) Int. Cl.
*G09F 7/00* (2006.01)

(52) U.S. Cl. ..... 40/601; 40/574; 40/575

(58) Field of Classification Search ..... 40/601, 40/470, 471, 472, 611.03, 574–576
See application file for complete search history.

(56) References Cited

U.S. PATENT DOCUMENTS

| | | | | |
|---|---|---|---|---|
| 1,072,799 | A | 9/1913 | Wall | |
| 2,515,978 | A | 7/1950 | Bauers | |
| 2,522,157 | A | 9/1950 | Bauers et al. | |
| 2,591,494 | A | 4/1952 | Asachika | |
| 2,856,077 | A | 10/1958 | Stanton, Jr. | |
| 3,426,461 | A * | 2/1969 | Miller | 40/471 |
| 3,609,898 | A | 10/1971 | Brown | |
| 3,673,720 | A | 7/1972 | Thornton | |
| 3,702,033 | A | 11/1972 | Coleman | |
| 3,938,269 | A | 2/1976 | Catteau | |
| 3,958,349 | A | 5/1976 | Nidelkoff | |
| 4,299,043 | A | 11/1981 | Lathrop et al. | |
| 4,368,586 | A | 1/1983 | Forzelias | |
| 4,411,084 | A | 10/1983 | Kraus | |
| 4,434,570 | A | 3/1984 | Roos | |
| 4,481,729 | A | 11/1984 | Weiller | |
| 4,627,766 | A | 12/1986 | Marquet | |
| 4,829,688 | A | 5/1989 | Mouraret et al. | |
| D338,966 | S | 8/1993 | Pinard | |
| 5,355,604 | A | 10/1994 | Rathke | |
| 5,359,796 | A | 11/1994 | Werling | |
| 5,423,142 | A | 6/1995 | Douglas et al. | |
| 5,471,774 | A | 12/1995 | Hoyt et al. | |
| 5,471,775 | A | 12/1995 | Hoyt et al. | |
| 5,520,236 | A | 5/1996 | Thomas et al. | |
| 5,529,274 | A | 6/1996 | Anderson et al. | |
| 5,542,203 | A * | 8/1996 | Luoma et al. | 40/610 |

(Continued)

FOREIGN PATENT DOCUMENTS

EP 453359 A * 10/1991

(Continued)

*Primary Examiner*—Cassandra Davis
(74) *Attorney, Agent, or Firm*—Stradley Konon Stevens & Young, LLP

(57) ABSTRACT

A sign display apparatus. The apparatus includes a moveable display face for displaying information; a stationary display body having a source of illumination for the display face when the display face is in a position over the display body; and a drive mechanism coupled to the display face for moving the display face relative to the stationary display body and its source of illumination. Also provided are an apparatus and a retrofit kit for lowering the display face to change a message displayed on the display face and for raising the display face to a visible position. Included are housing assemblies affixed in a spaced relationship, each housing assembly having a guide track such that, in combination, the housing assemblies provide a pair of substantially parallel guide tracks into which is disposed the display face, thereby defining a plane of travel as the display face is lowered and raised.

28 Claims, 13 Drawing Sheets

U.S. PATENT DOCUMENTS

| | | | |
|---|---|---|---|
| 5,701,695 | A | 12/1997 | Current |
| 5,941,001 | A | 8/1999 | Dietrich et al. |
| 5,979,671 | A | 11/1999 | Pan et al. |
| 6,055,754 | A | 5/2000 | Mclhuus |
| 6,148,554 | A | 11/2000 | Dietrich et al. |
| 6,155,326 | A | 12/2000 | Imhoff et al. |
| 6,182,386 | B1 | 2/2001 | Nielsen |
| 6,257,418 | B1 | 7/2001 | Allen et al. |
| 6,327,803 | B1 | 12/2001 | Ruderman |
| 6,332,283 | B1 | 12/2001 | Archer |
| 6,464,190 | B1 | 10/2002 | Aramaki |
| 2002/0035799 | A1 | 3/2002 | Ellingsen |
| 2002/0133989 | A1 | 9/2002 | Alexander et al. |
| 2002/0140555 | A1 | 10/2002 | Jette et al. |

FOREIGN PATENT DOCUMENTS

| | | | | |
|---|---|---|---|---|
| GB | 2268303 | A | * | 1/1994 |

* cited by examiner

UP-AND-DOWN DISPLAY SIGN

TECHNICAL FIELD

The present invention relates generally to display signs and, more particularly, to a system for supporting and moving a sign face so that it can be changed frequently and easily to provide new messages.

BACKGROUND OF THE INVENTION

Many businesses such as fast food outlets, gasoline service stations, quick-stop or convenience stores, theaters, and other such businesses often display information about their products, services, and prices on outdoor display signs near the places of business. A common form of outdoor commercial signage is comprised of a metal rectangular box containing fluorescent tubes illuminating a translucent face on one or two sides. The box may be mounted on a wall or supported by one or more poles or support columns. Typically, single or double-faced electric signs are mounted on two poles, often called "goal post" or "pylon" signs. Literally millions of such signs are in use nationally in all variety of applications for businesses large and small. Face dimensions may vary from less than twenty to over several hundred square feet.

A subset of the pylon-type of signs is mid-sized pylon signs that need "changeable graphics." In other words, the information on the signs must sometimes be changed based on updates in market conditions, competition, and the products or services that are marketed by the business establishment. The price digits on gas station signs, the list of "specials" at convenience stores, the titles of movies showing at a theater—all are examples of changeable graphics. Various devices have been used to accomplish the process of changing the information on the signs.

Historically, fixed "reader boards" were used, whereby numbers and letters were positioned in grooves by a person standing on a ladder. More recently, changeable marquee signs use clip-in numbers and letters that are raised to the sign face by an operator using a long pole with a suction cup. High winds tended to blow the numbers and letters from the grooves, however, often tearing them and requiring replacement. Numbers and letters are easily lost or broken and are costly to replace. Layouts tend to be sloppy and limited in length; images, restricted in their design. In addition, such devices often placed personnel at risk (as they climb and work from high ladders) and required excessive amounts of time and labor because changing copy is slow and difficult work, especially in hot, cold, wet, or windy conditions.

To avoid these problems, devices which allow the sign to be lowered to ground level while the display is changed and then raised to its normal display height have been developed. Inevitably these devices create as many problems as they solve. If the sign is lowered to ground level for changing, special winch systems are usually employed along with a guide system to restrain the sign from swinging while being lowered. This is usually a result of such signs being heavily constructed. The process of lowering such signs often requires two or more people to accomplish the task.

U.S. Pat. No. 3,958,349 issued to Nidelkoff discloses a sign that can move in a vertical direction on a frame. The sign faces are arranged so that there is sufficient space on the interior of the sign, between the sign faces, to place a bank of lights. The sign is positioned with a winch which may be operated manually or with an electric motor. The winch is connected to the sign by a pulley and cable system that may be arranged on the interior of the frame.

U.S. Pat. No. 3,938,269 issued to Catteau is directed to an illuminated display case that has a motor-driven drum for raising the notice, poster, or placard through a slot in the bottom of the case. The case has a light source in the form of fluorescent tubes. At the bottom of the case is a slot or access opening through which the poster can be lowered for changing by operating an electric motor through push buttons. When the drum unwinds, the plasticized linen, blind, or flexible element, to which the poster is attached, is lowered and can be changed. In an alternative embodiment, the drum does not have a flexible panel but two spaced links such as chains, cables, or wires according to the strength and flexibility required. To prevent overwinding, an idler roller is provided with a component able to tilt and break contact and stop the motor when the poster is in the proper position.

U.S. Pat. No. 5,529,274 issued to Anderson et al. is directed to a sign suspension system that is ceiling-mounted and remotely controlled to raise and lower the sign. The sign support system includes a ceiling attachment and a motor-operated drum unit that includes a control circuit with an antenna, a reversible, and a reduction gear driven by a motor to operate the drum. The control unit is operated by a remote control unit through the antenna in a manner similar to radio-controlled garage doors. When the sign suspension system is operated so as to lower the sign, a cord is lengthened so that, as it passes through sheaves, a main rail lowers. The main rail supports side rails that can be adjusted to provide a total length equal to the width of the sign that is to be displayed. The sign is inserted between the rail sections and thumb screws are passed through the sign and rail sections and tightened.

U.S. Pat. No. 6,327,803 issued to Ruderman is directed to a system having several embodiments. The system is used to raise and lower banners, flags, or posters which are suspended from a support member mounted to the ceiling. The first embodiment has a ceiling unit with a tubular housing horizontally oriented relative to an elongate shaft for rotation by a reversible motor. Openings at opposite sides provide access to the shaft for lines to support a banner. A control device permits operation of the system from the floor. The control device comprises a housing containing an electric battery and has a handle so that the control device may be held while standing on the floor. A paddle with electric contacts can engage contacts on the ceiling housing for operating the motor. In the ceiling housing is provided a brake that frictionally engages the axle when the motor is not being operated so as to restrict movement of the banner or sign.

In a further embodiment, the motor is located in the control device. A drive train in the form of an endless chain is connected to a cog provided on the paddle end of the control device that engages a cog provided on the axle of the ceiling unit, thus supplying power for raising and lowering the banner. In a further embodiment, a cog is mechanically driven by a crank rather than an electric motor, the crank being located in the handle section of the control device.

In other embodiments, instead of an endless chain or belt, a flexible cable supported by a rigid rod could transfer the power to the ceiling unit. A further contemplated embodiment involves the use of 90° gearing orientation such as a pinion and bevel gear, skew bevel, or worm gear which would translate the rotational movement of the elongate vertical pull to an intersecting transverse axle on which the driving cog is mounted. A further embodiment which uses a 90° gear engagement to transfer power from the control rod to the ceiling unit has a control device with a hook at the terminal end of an extended rod that is telescopic and its length may be adjusted by the rotation of frictional collars. A frictional clutch is provided to engage the control rod and transfer power from the motor. In an alternate contemplated embodiment, the control rod is engaged by a chuck such as found on conventional power drills. Such devices that are available in rechargeable battery powered models could be used in connection with this system to power the raising and lowering of a sign or banner.

U.S. Pat. No. 6,332,283 issued to Archer is directed to a price totem that has a vertical slideway for mounting a carriage that carries numbers and can be moved from an upper display position to a lower price change position easily accessed by a person standing on the ground. The indicating mechanism for a price display device comprises an outer frame on which is mounted an inner frame defining a vertical slideway along which a carriage can be moved from the elevated display position to the lower price change position. The carriage may have a single number location or a number of vertically spaced locations. Upper and lower pulleys are mounted on the top and bottom of the frame with a cord, rope, or chain extending from the top of the carriage around the pulley to the upper end of a center weight. A second cord, rope, or chain is attached to the lower end of the weight, extends around the lower pulley, and is attached to the bottom of the carriage. The carriage, two cords, and weight form a closed loop. The operator can pull down or up on the cord, rope, or chain to change the position of the carriage.

U.S. Patent Application Publication No. 2002/0035799 filed by Ellingsen is directed to a suspension device for displaying a poster or the like on the side of a wall. The device has a pulley arrangement that eliminates the need for a large, stiff, heavy top bar. A poster with a thick upper and lower edge is slid into undercut grooves in the top bar and lower bar. Wall elements are attached to a wall along which the poster is to be suspended. A cord for raising and lowering the poster is secured to one wall element and is fed through the four pulleys on the upper bar and over the pulleys in the wall elements. The lower bar, due to its own weight, will keep the poster stretched during raising. The upper bar will not flex, even when it is of large length, because it is supported in at least three regions.

U.S. Pat. No. 5,471,775 issued to Hoyt et al. discloses a pull-down signboard and relatively complex support frame adaptable to existing vertical sign columns capable of retrofit over existing signs. The signboard and support frame are mounted on a single column and use a pulley system with counterweights inside a cable channel running along either side of the column so that the sign can be lowered to ground level. The operator uses a pole and hook with a special extendable retracting handle, while standing on the ground, to unlatch and lower for sign alteration, then raise and latch following sign alteration, the signboard and support frame. The manual system is time-consuming and requires both strength and effort. No brake or guide tracks are provided to assure safety.

To overcome the shortcomings of conventional outdoor commercial signage, a new system for installing, supporting, and moving sign faces for such signs is provided. An object of the present invention is to provide an improved mechanism for installing, supporting, and moving sign faces for commercial signs. A related object is to provide a system that can be easily retrofitted over existing commercial signage. Another object is to allow a sign face to be moved without the need to move the underlying sign box and the illumination source of the sign box.

It is still another object of the present invention to provide a system which can be used separately for each face of a sign display that has multiple sign faces thereby enabling a user of the system to separately raise and lower each sign face of the sign display. Yet another object of this invention is to provide separate moving systems which allow each sign face to be moved independently. A further object of the present invention is to provide a system which allows a single person to simply and automatically pull down a sign panel, change the information on the sign panel, and return the sign panel to its display position safely, economically, and in a very short period of time.

SUMMARY OF THE INVENTION

To achieve these and other objects, and in view of its purposes, the present invention provides a sign display apparatus engaging a sign support. The sign display apparatus comprises a moveable display face for displaying information; a stationary display body having a source of illumination for illuminating the display face when the display face is in a position over the display body; and a drive mechanism coupled to the display face for moving the display face relative to the stationary display body and its source of illumination.

Also provided is an apparatus for lowering a moveable display face to change a message displayed on the display face and for raising the moveable display face to a visible position. The apparatus comprises first and second housing assemblies affixed in a spaced relationship, each housing assembly having: (a) an outside surface defining an internal cavity, and (b) a guide track extending along at least a portion of the outside surface of the housing assembly such that, in combination, the housing assemblies provide a pair of substantially parallel guide tracks into which is disposed the display face, thereby defining a plane of travel as the display face is lowered and raised. In addition, the apparatus includes a drive mechanism located within the cavities of the first and second housing assemblies and coupled to the display face for moving the display face in the guide tracks and relative to the housing assemblies.

The present invention also provides a kit especially adapted to retrofit existing sign structures. The parts of the kit function to lower a moveable display face, enabling an operator to change a message displayed on the display face, and to raise the moveable display face to a visible position covering a stationary display body having a source of illumination for illuminating the display face when the display face is in position over the display body. The kit comprises first and second housing assemblies adapted to be affixed to a support structure in a spaced relationship. Each housing assembly has: (a) an outside surface defining an internal cavity, and (b) a guide track extending along at least a portion of the outside surface of the housing assembly such that, in combination, the housing assemblies provide a pair of substantially parallel guide tracks into which is disposed the display face, thereby defining a plane of travel as the display face is lowered and raised. In addition, the kit includes a drive mechanism located within the cavities of the first and second housing assemblies and coupled to the display face for moving the display face in the guide tracks and relative to the housing assemblies.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

The present invention allows an operator to raise and lower a sign or display face for changing a message displayed on the display face. The invention can be used with newly manufactured signs, or to retrofit the vast number of existing signs already in use. For a new sign, adding the system of the present invention is relatively simple and economical. For a retrofit application, which can be accomplished in only a few hours at a fraction of the cost of a replacement sign, the existing sign face or faces are removed and may or may not be reused. A pair of pre-assembled housing assemblies are attached to the existing pylon poles.

Each housing assembly contains a simple system of gears, cables, pulleys, counter-weights, and guide tracks to raise and lower the display face as the operator activates a force. A mechanical safety brake prevents the face from dropping down in the event of a cable failure. A new display face may also be provided, which travels within the guide tracks of the bilateral housing assemblies. The illuminated display face may be a conventional "marquee" (a rigid substrate having channels to receive removable alphanumeric characters). Alternatively, the entire face may be replaceable.

Figure 1A:
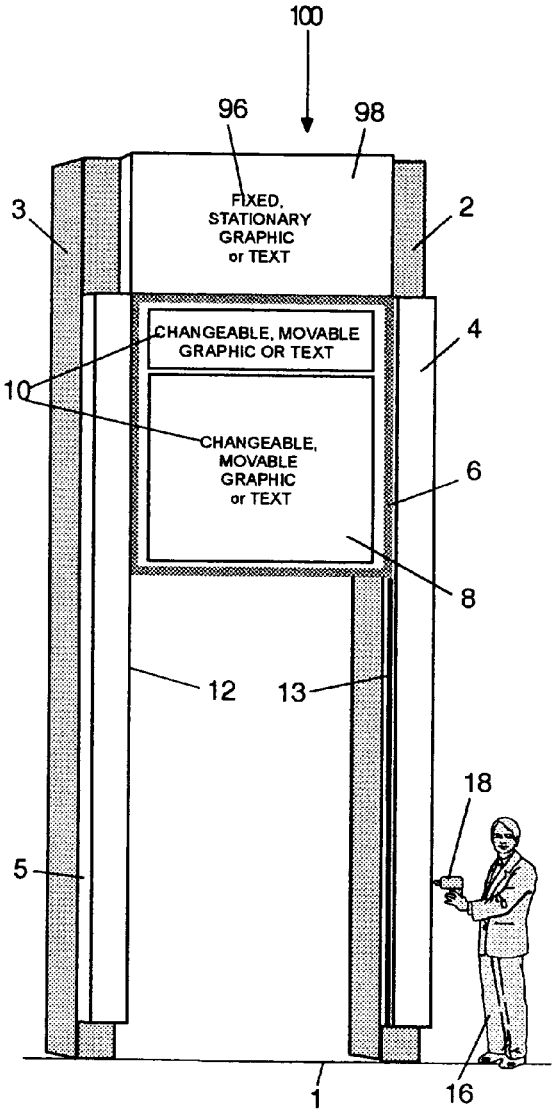
FIG. 1A is a perspective view of an exemplary embodiment of the display according to the present invention showing a display face in an upper position.
Figure 1B:
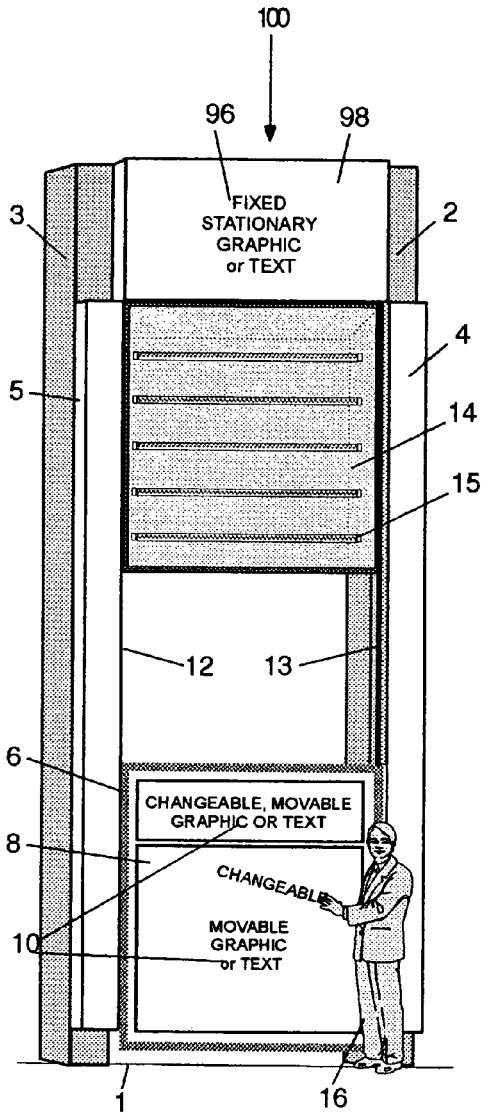
FIG. 1B is a perspective view of an exemplary embodiment of the display according to the present invention showing a display face in its lower position.

Referring now to the drawing, in which like reference numbers refer to like elements throughout the various figures that comprise the drawing, FIGS. 1A and 1B show a perspective view of the outside of an exemplary embodiment of the invention. FIG. 1A shows a sign stand 100 having a fixed, stationary sign 98 at the top. That is, sign 98 may not be moveable. In an alternative embodiment, sign 98 may be moveable. In the exemplary embodiment, sign 98 may have graphic or text information 96, or both graphic and text information 96 that may be a permanent part of sign 98.

In an alternative embodiment, the information 96 on sign 98 may be removable and changeable. In one embodiment, individual letters, words or other alpha-numeric information 96 on sign 98 may be removable and changeable. In another embodiment, all of the individual letters or all of the alpha-numeric information 96 on sign 98 may be removable and changeable. In yet another embodiment, sign 98 may include information 96 generated electronically so that part or all of the message on sign 98 may be changed electronically. In still another embodiment, sign 98 may be computer generated. In yet another embodiment, sign stand 100 need not have a fixed stationary sign 98 at the top, or at any location.

Sign stand 100 includes display body 14. In an exemplary embodiment, display body 14 is a rectangular cavity. In an alternative embodiment, display body 14 may have a different shape. Display body 14 contains a luminous source 15 which transilluminates a display face 8 to enhance and facilitate the visibility and legibility of display face 8 when ambient light is limited. Luminous source 15 may be a plurality of light bulbs or other suitable source of illumination. In alternative embodiments, display body 14 may contain more or fewer light bulbs compared to those shown in FIG. 1B and may contain different kinds of light sources entirely.

Display face 8 on sign stand 100 can be changed and moved. In an alternative embodiment, there may be a second display face disposed on the side of sign stand 100 opposite display face 8 (see FIG. 2B). FIG. 1A shows display face 8 in an uppermost position relative to sign stand 100. FIG. 1B shows display face 8 in a lowermost position relative to sign stand 100. In alternative embodiments, display face 8 may be located between the uppermost and lowermost positions.

Display face 8 may be enclosed and supported on all sides by a display face retainer 6. In an alternative embodiment, display face retainer 6 may not enclose display face 8 on all sides. According to the present invention, only display face retainer 6 and display face 8 enclosed by display face retainer 6 are raised and lowered. Display body 14 and luminous source 15 contained in display body 14 are fixed and do not move.

In an exemplary embodiment, display face 8 may display one or more graphic or alphanumeric messages 10. In the exemplary embodiment, messages 10 may comprise a single subject. In an alternative embodiment, messages 10 may comprise a plurality of subjects. In all of the embodiments, some, or all, of messages 10 may be changeable or moveable.

In an exemplary embodiment, display face 8 may be removed in its entirety. In an alternative embodiment, part of display face 8 may be removed from sign stand 100. In yet another embodiment, display face 8 may remain in sign stand 100 and an operator 16 may remove part or all of messages 10 and replace them with other messages 10. In still another embodiment, display face 8 may include a screen that may display electronic messages 10 or computer-generated messages 10 or may include another display medium. Such a screen may be removable or non-removable. Use of alternative types of display faces or screens may allow operator 16 to effectively change messages 10 without removing display face 8. Such a display face or screen may exist as a component of an established, pre-existing display or may be created and installed as part of the invention.

When display face 8 is in its lowermost position, operator 16 may easily replace messages 10 on the sign face, easily place other kinds of messages 10 on display face 8, or both. In alternative embodiments, different kinds of messages 10 may be placed on display face 8 including, but not limited to, words, drawings, photographs, computer-generated designs, graphics and combinations of any and all of them. In an embodiment where a second display face may be placed on the opposite side of sign stand 100, the second display face may display the same kinds of messages 10 that may be displayed on display face 8. The messages 10 conveyed by the second display face may be the same as or different from messages 10 conveyed by display face 8.

Sign stand 100 is supported by a first support pole 2 and a second support pole 3 which may be equal in length, parallel to each other, and rigidly attached to a surface 1. Surface 1 may be a sidewalk, driveway, rooftop, or other fixed surface. In an exemplary embodiment, support poles 2 and 3 may be made of metal. In alternative embodiments, they may be made of any other sturdy material. Either one or both of support poles 2 and 3 may be a component of an established, pre-existing display structure. In an alternative embodiment, where there may not be a pre-existing display structure, either one or both of support poles 2 and 3 may be created and installed as new construction.

Upon each support pole 2 and 3, one of a pair of housing assemblies 4 and 5 are firmly attached. Housing assembly 4 is attached to support pole 2 and housing assembly 5 is attached to support pole 3. Each of housing assemblies 4 and 5 may be made of metal (preferably fabricated from a custom aluminum extrusion) or other similarly sturdy material (e.g., steel). Housing assemblies 4 and 5 have corresponding external geometries, are mounted parallel to support poles 2 and 3 and parallel to each other, and may have dimensions which enable them to be mounted onto existing support poles 2 and 3 so that an existing sign structure may be retrofitted with the system of the present invention.

Housing assemblies 4 and 5 are attached to support columns 2 and 3 at a height allowing safe, convenient, and effective operation of the display system by operator 16. In an exemplary embodiment, the bottoms of housing assemblies 4 and 5 may not only be attached to support poles 2 and 3, they may also be attached to surface 1. In an alternative embodiment, the bottoms of housing assemblies 4 and 5 may not be attached to surface 1. The tops of housing assemblies 4 and 5 are attached to support poles 2 and 3 in close proximity to the uppermost position of display face 8, which typically but not necessarily is near the tops of support poles 2 and 3, respectively.

Figures 2A, 2B:
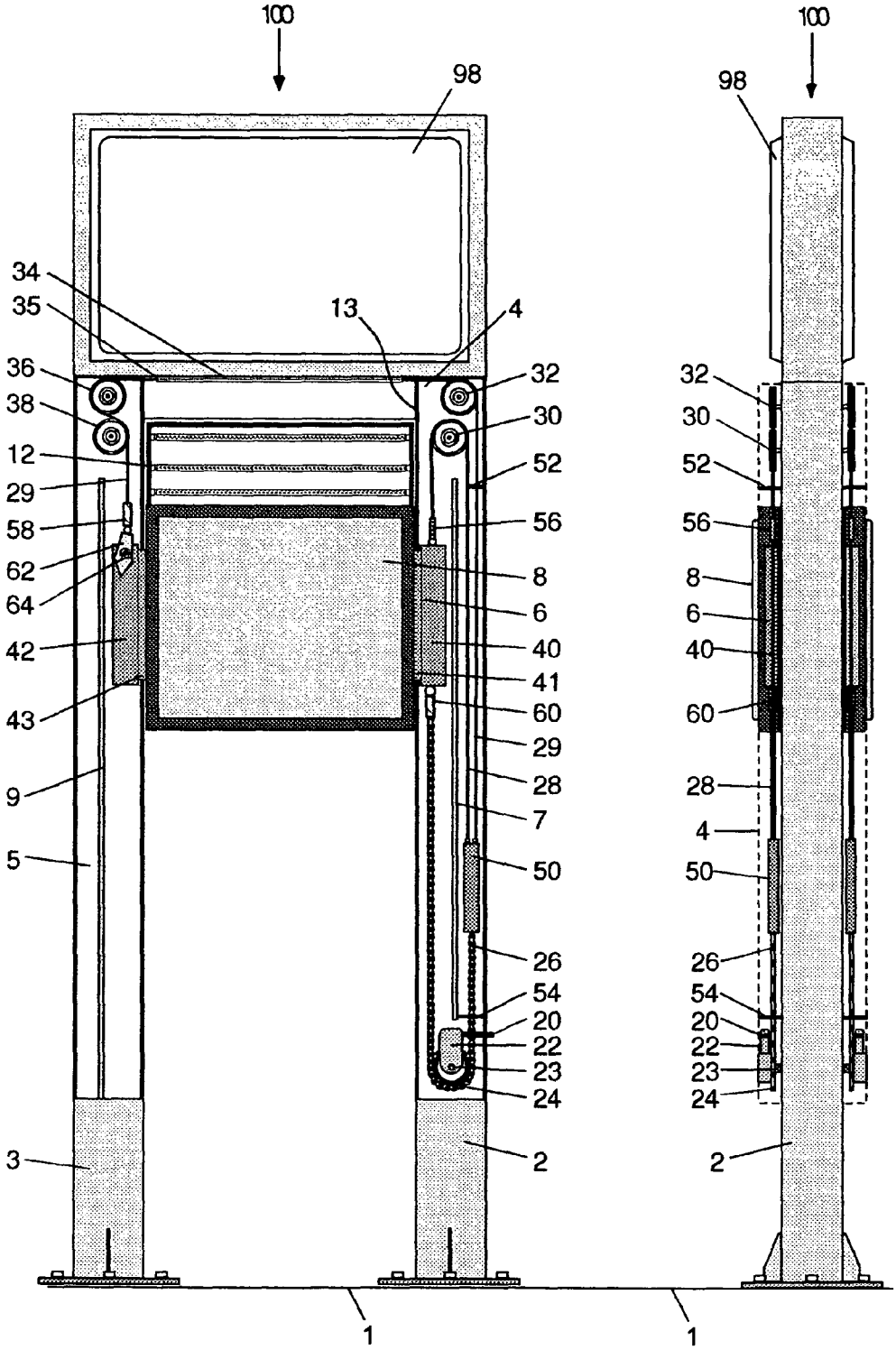
FIG. 2A is front view of an exemplary embodiment of the system according to the present invention.
FIG. 2B is a side view of an exemplary embodiment of the system according to the present invention.

Referring to FIGS. 2A and 2B, there is a space within housing assembly 4 and within housing assembly 5. Each space may run from the bottom to the top of each housing assembly 4 and 5. Within the space inside housing assembly 4 and inside assembly housing 5 are components which are used to raise and lower display face retainer 6 and display face 8 along a vertical axis that is parallel to the axes of support poles 2 and 3 and parallel to the axes of housing assemblies 4 and 5.

In an exemplary embodiment, display face retainer 6 may be made of metal and is designed to allow safe, convenient, and efficient replacement of display face 8. In alternative embodiments, display face retainer 6 may be made of any other material that is sturdy, will not unduly deteriorate, and will allow safe, convenient, and efficient replacement of display face 8 which it retains. Display face 8 may exist as a component of an established, pre-existing display or may be created as part of the invention that is newly installed at a site. Support poles 2 and 3, housing assemblies 4 and 5, display face retainer 6, and display face 8 may be of variable scale and dimension, each ranging to several feet and to tens of feet.

As the present invention allows for rapid vertical lowering of display face retainer 6 containing display face 8 and for simple removal and replacement of display face 8 within display retainer assembly 6, an exemplary embodiment allows for complete replacement of display face 8 within display face retainer 6. When display face 8 is replaced, the entire message 10 that is contained on display face 8 may be replaced in a timely, safe, convenient, and efficient manner by operator 16 standing on surface 1. In an alternative embodiment, display face retainer 6 may allow for a partial replacement of display face 8. For example, display face 8 may be divided into two or more sections instead of comprising only one section and display face retainer 6 may allow one or more sections of display face 8 to be removed and replaced with different sections having new messages 10.

In an exemplary embodiment, display face 8 may be a component of a pre-existing sign display and the present invention may be used to retrofit the pre-existing sign display. In an alternative embodiment, display face 8 may be installed along with display face retainer 6 and with the remainder of the present invention as partial or fully new construction.

Referring to FIGS. 1A, 1B, and 2A, guide tracks 12 and 13 are shown as part of housing assemblies 4 and 5, respectively. Guide tracks 12 and 13 form two vertical tracks within housing assemblies 4 and 5, respectively, that are parallel to each other, parallel to and coextensive with the length of housing assemblies 4 and 5, and parallel to support poles 2 and 3. That is, guide tracks 12 and 13 may extend between the top and bottom of housing assemblies 4 and 5. The lengths of guide tracks 12 and 13 may be the same as the lengths of housing assemblies 4 and 5. In an alternative embodiment, guide tracks 12 and 13 may not extend from the top to the bottom of housing assemblies 4 and 5 but may extend for a shorter distance. One or both of guide tracks 12, 13 guide the raising and lowering of display face retainer 6 and display face 8. Guide tracks 12 and 13 thus define the axes of movement for, and limit the path of movement of, display face retainer 6 and display face 8. Guide tracks 12, 13 may be lined with plastic or otherwise tailored to reduce friction as display face retainer 6 and display face 8 slide within the confines of guide tracks 12, 13.

As operator 16 manipulates the display sign and lowers display face retainer 6 and display face 8, the underlying structure of display body 14 is uncovered. Raising or lowering of display face retainer 6 and display face 8 may be performed by operator 16 employing a power source 18. In an exemplary embodiment, power source 18 may be a hand-held, cordless, motor-driven apparatus which may be attached to and detached from the structure of the invention. Power source 18 provides power to raise and lower display face 8 as per the needs and actions of operator 16. In an alternative embodiment, a detachable manual hand crank may be used instead of a cordless power source 18. In yet another embodiment, an electrically powered detachable power source 18 may be used. In still another embodiment, a non-detachable drive motor may be used.

Regardless of the embodiment, operator 16 applies power source 18 from a position safely removed from the plane of travel for display face retainer 6 and display face 8 as those components are lowered and raised. Such a position avoids the risk of injury should a mechanical failure cause display face retainer 6 and display face 8 to fall inadvertently. Typically, operator 16 stands to the side of support pole 2 as illustrated in FIGS. 1A and 1B. Other suitable positions might be envisioned, however, keeping the safety consideration in mind.

FIG. 1B shows operator 16 altering message 10 while standing on surface 1. As shown, operator 16 has little or no need to be elevated by a supporting object (e.g., a ladder) due to the lowered vertical position of the display face 8 as achieved by the present invention. Although this embodiment of the invention shows two distinct areas of alterable message 10 contained within display face retainer 6, any number of alterable messages 10 on a removable or non-removable display face 8 may be used, either through the creation of new components, the utilization of existing components, or any combination of these types.

Referring to FIG. 2A, housing assembly 4 may be designated as an active housing assembly or as a drive-side housing assembly and assembly housing 5 may be designated as a passive housing assembly or as a balancing-side housing assembly. As explained in detail below, housing assemblies 4 and 5 house drive mechanism components that raise and lower display face 8. Active housing assembly 4 has an input shaft 20 which may receive power from power source 18. Input shaft 20 may be an integral part of, or at least engage or be coupled to, a gear reduction assembly 22 (also called a speed reducer). The opposite end of input shaft 20 engages power source 18.

As illustrated, the part of input shaft 20 coupled to gear reduction assembly 22 may be inside housing assembly 4 and the end of input shaft 20 which engages power source 18 may extend outside housing assembly 4. Alternatively, all of input shaft 20 may be inside housing assembly 4, with the end of input shaft 20 which engages power source 18 recessed within housing assembly 4 but still accessible to power source 18. In an exemplary embodiment, input shaft 20 may be made of metal. In another embodiment, input shaft 20 may be made of any sturdy material which may be able to receive power from power source 18 and to transmit the power to the remainder of the system (e.g., via gear reduction assembly 22).

The part of input shaft 20 that is coupled to gear reduction assembly 22 may be a cylindrically shaped shaft while the end of input shaft 20 that engages power source 18 may be square shaped at least at its tip. In an exemplary embodiment, the end of input shaft 20 that engages power source 18 may serve as a male element which may be easily, firmly, and securely received by a corresponding female square element of power source 18. Power source 18 may be analogously designed to have a square shape. Power source 18 rotates when operator 16 activates it, typically with a finger trigger. In an alternative embodiment, the end of input shaft 20 and the corresponding element of power source 18 may be any shape. For example, the end of input shaft 20 may be a female element which may receive a corresponding male element from power source 18.

Gear reduction assembly 22 may be rigidly fixed to housing assembly 4, to support pole 2, or to both components. Coupled to gear reduction assembly 22 is an output shaft 23 which, in turn, is rigidly and concentrically coupled to a drive wheel 24. Gear reduction assembly 22 and output shaft 23 may both be inside housing assembly 4. Drive wheel 24 may have a metal sprocket with multiple teeth. Gear reduction assembly 22, output shaft 23, and drive wheel 24 are components that are well known to those skilled in the art. The force delivered to input shaft 20 may be coupled through gear reduction assembly 22 which redirects the force via output shaft 23 to drive wheel 24. The mechanical advantage in an exemplary embodiment is determined by the gear ratio of the component gears of gear reduction assembly 22 and the ratio of the circumference of drive wheel 24 to the circumference of input shaft 20. In an exemplary embodiment, gear reduction assembly 22 may be a worm and worm gear. In another embodiment, a different kind of gear assembly may be employed.

Also inside housing assembly 4 is a drive belt 26 that may be coupled to the teeth of drive wheel 24. Drive belt 26 may be a roller chain made of metal. In an alternative embodiment, drive belt 26 may comprise other materials and other shapes. The mechanical advantage of this machine facilitates the movement of drive belt 26 when force is conducted into the machine from power source 18. In an exemplary embodiment, drive belt 26 may move at a rate of 20 to 100 feet per minute when force is applied by power source 18 at a rate of 500 to 3,000 revolutions per minute. In an alternative embodiment, drive belt 26 may move at a different rate and power source 18 may apply force at a different number of revolutions per minute. The redirection of the axis of rotation between input shaft 20 and output shaft 23 by this machine places operator 16 at a position that is safely distant from the path of movement of display face 8 and display face retainer 6.

One side of drive belt 26 may be attached to one side of a weight 50 inside housing assembly 4. In an exemplary embodiment, weight 50 may be made of metal. In an alternative embodiment, weight 50 may be made of any material which is sturdy and which weighs a sufficient amount. In an exemplary embodiment, weight 50 may weigh several pounds. In an alternative embodiment, weight 50 may equal the total weight of the movable display assembly. Still another alternative is to divide weight 50 and position separate portions in housing assemblies 4, 5—perhaps with each portion weighing about half of the total weight of the movable display assembly. In an exemplary embodiment, weight 50 may be a fixed weight. In an alternative embodiment, weight 50 may comprise an assembly that can provide a variable weight, especially adapted for adjustment during assembly on site and determined based upon the particular application.

The other side of drive belt 26 may be attached to one side of a drive-side tensioning spring 60. In an exemplary embodiment, the other side of drive-side tensioning spring 60 is connected to one side of a drive-side display retainer connector 40 which is also inside housing assembly 4. Thus, drive-side tensioning spring 60 may be inserted between drive belt 26 and a retainer connector 40. In another embodiment, drive-side tensioning spring 60 may be placed between any two components of the continuous loop formed by the drive mechanism components of the drive side housing.

In an exemplary embodiment, drive-side tensioning spring 60 may be made of metal and may comprise an extension-limiting drawbar design. In an alternative embodiment, a different design may be used for drive-side tensioning spring 60. Drive-side tensioning spring 60 may ensure tension of the mechanism if stretch elongation occurs within the mechanism. Drive-side tensioning spring 60 may be unnecessary, however, at least in those applications for which stretch elongation is unlikely.

One side of drive-side display retainer connector 40 includes a tab 41 that protrudes through guide track 13, beyond the confines of housing assembly 4, and attaches to a side of display face retainer 6. A balancing-side display retainer connector 42 is located inside housing assembly 5. One side of balancing-side display retainer connector 42 includes a tab 43 that protrudes through guide track 12, beyond the confines of housing assembly 5, and is attached to another side of display face retainer 6. Display retainer connectors 40 and 42, display face retainer 6, and display face 8 together comprise a display assembly.

When display retainer connectors 40 and 42, display face retainer 6, and display face 8 are assembled as a unit, the up and down motion of the unit is guided by guide tracks 12 and 13. The display assembly moves up and down along the parallel, vertical axes of the housing assemblies 4 and 5. The movement of the display assembly to the uppermost vertical extreme allows for optimal visibility and transillumination of display face 8. Movement of the display assembly to the lowermost vertical extreme allows for the most efficient and safest changing of messages 10 by operator 16.

The side of weight 50 opposite drive belt 26 may be connected to a pair of hoist lines 28 and 29, each of which may be cables: a drive-side hoist line 28 and a balancing-side hoist line 29. Drive-side hoist line 28 is inside housing assembly 4 and balancing-side hoist line 29 is inside both housing assembly 4 and housing assembly 5. In an exemplary embodiment, each of hoist lines 28 and 29 may be made of stranded metal cable. In an alternative embodiment, one or both of hoist lines 28 and 29 may be made of any material that is strong enough to support and move the sign display. Hoist line 28 and drive belt 26 form a continuous loop on the drive side along with drive-side retainer connector 40 and, optionally, drive-side tensioning spring 60 and a drive-side hoist line adjuster 56.

Within housing assembly 4 is a housing assembly internal member 7 which is attached to the front and rear walls of housing assembly 4. Within housing assembly 5 is a housing assembly internal member 9 which is attached to the front and rear walls of housing assembly 5. In an exemplary embodiment, housing assembly internal members 7 and 9 may be made of metal. In an alternative embodiment, housing assembly internal members 7 and 9 may be made of any material that is sufficiently sturdy. Hoist lines 28 and 29 ascend and descend on a vertical axis within a cavity that is defined by the outer wall of housing assembly 4 and housing assembly internal member 7. On the balancing side, balancing-side hoist line 29 ascends and descends vertically within a space that is defined by a wall of housing assembly 5 and housing assembly internal member 9. Movement of hoist lines 28 and 29 is defined in amount and direction by the rotation of drive wheel 24 and the corresponding movement of drive belt 26.

At the upper end of housing assembly 4 is a drive-side lifting pulley 30 which is a grooved sheave rotatably mounted on a shaft attached to housing assembly 4. From its attachment to weight 50, drive-side hoist line 28 moves along a path vertically to drive-side lifting pulley 30, then extends over and around drive-side lifting pulley 30. Guided by drive-side lifting pulley 30, drive-side hoist line 28 descends from drive-side lifting pulley 30 in a parallel axis on the opposite side of drive-side lifting pulley 30. Drive-side hoist line 28 descends within housing assembly 4 and within a space that is defined by housing assembly 4 and housing assembly internal member 7. The descending end of drive-side hoist line 28 may be attached to one side of drive-side hoist line adjuster 56. In an alternative embodiment, drive-side hoist line adjuster 56 may be unnecessary.

If present, the other side of drive-side hoist line adjuster 56 may be coupled to drive-side display retainer connector 40. In an exemplary embodiment, drive-side hoist line adjuster 56 may be a turnbuckle made of metal. The purpose of drive-side hoist line adjuster 56 is to provide tension to drive-side hoist line 28, keeping drive-side hoist line 28 taught and within the groove of drive-side lifting pulley 30. In an alternative embodiment, drive-side hoist line adjuster 56 may be any device that can keep drive-side hoist line 28 taught and within the groove of drive-side lifting pulley 30. In an alternative embodiment, drive-side hoist line adjuster 56 may be placed between any two components comprising the continuous loop of the drive-side mechanism components. In such an alternative embodiment, drive-side hoist line 28 may be attached directly to drive-side display retainer connector 40.

As shown in FIG. 2A, an exemplary embodiment uses two pulleys in housing assembly 4 and two pulleys in housing assembly 5. In an alternative embodiment, there may be more or fewer than two pulleys in each housing assembly 4, 5. FIG. 2A also shows two hoist lines 28, 29 in housing assembly 4 and one hoist line 29 in housing assembly 5. In an alternative embodiment, there may be more or fewer hoist lines in each housing assembly 4, 5.

Balancing-side hoist line 29 moves vertically along a path from weight 50 to a balancing-side sending pulley 32. In an exemplary embodiment, balancing-side sending pulley 32 may be a grooved sheave rotatably mounted to a shaft which is attached to housing assembly 4. Balancing-side hoist line 29 proceeds over and around and is guided by balancing-side sending pulley 32. Balancing-side hoist line 29 departs balancing-side sending pulley 32 along a perpendicular axis and is threaded through a balancing-side hoist line guide 34 which is attached to a flashing cap 35 attached to housing assemblies 4, 5.

Balancing-side hoist line guide 34 is an enclosed channel which conducts drive-side hoist line 29 from balancing-side sending pulley 32 to a balancing-side receiving pulley 36. Balancing-side receiving pulley 36 is preferably mounted to a shaft attached to housing assembly 5. Balancing-side sending pulley 32 is within and attached to housing assembly 4. Just beneath balancing-side receiving pulley 36 is a balancing-side lifting pulley 38 which is also within and attached to housing assembly 5. Pulleys 36 and 38 may each be a grooved sheave rotatably mounted to a shaft attached to housing assembly 5.

From balancing-side receiving pulley 36, balancing-side hoist line 29 continues over and around and is guided by balancing-side receiving pulley 36 to depart pulley 36 at an angle directed towards balancing-side lifting pulley 38. Pulley 38 guides the descending portion of balancing-side hoist line 29 to depart pulley 38 on an axis that is approximately parallel to the descending drive-side hoist line 28. Weight 50 provides tension to hoist lines 28 and 29 to keep them taught and within the grooves of the various pulleys 30, 32, 36, and 38. Weight 50 balances the downward force of the display assembly on the hoist lines 28 and 29 and thereby reduces the amount of force required by power source 18 to operate the mechanism of the invention.

The descending end of balance-side hoist line 29 may be attached at its terminal to a balancing-side hoist line adjuster 58 which may, in turn, attach to one side of a safety brake 62. The other side of safety brake 62 may be attached to balancing-side retainer connector 42 within the confines of housing assembly 5. In an exemplary embodiment, balancing-side hoist line adjuster 58 may be a turnbuckle made of metal. It may vary the total length of the balancing-drive mechanism components so that the sides of display face retainer 6 and the sides of display face 8 are held approximately parallel to the vertical axes of housing assemblies 4 and 5. In an alternative embodiment, different kinds of balancing-side hoist line adjusters may be used or none at all.

In an exemplary embodiment, safety brake 62 may be a metal structure rotatably mounted on a pivot pin 68 passing perpendicularly through either or both of the display retainer connectors 40 and 42. The brake or brakes may be engaged by a brake actuator spring 64 which may be a metal torsion spring and which also engages the display retainer connectors 40 and 42. Brake actuator spring 64 may be activated to position safety brake 62 nearly horizontal to engage the inside surface, preferably formed via a locking groove 66, of housing internal member 9 at an acute angle and thereby inhibit the downward movement of the display face assembly. In an alternative embodiment, safety brake 62 may be a pair of elongated metal plates and both of the plates may be engaged by brake actuator spring 64.

Balancing-side hoist line 29 is flexibly attached to an end of safety brake 62 that is farthest from the engaging surface and may apply enough force such that safety brake 62 rotates to nearly a vertical position at which time it disengages from the internal surface of housing assembly internal member 9. In such a vertical orientation, safety brake 62 allows uninhibited upward and downward movement of the display face assembly. The upward and downward movement may be inhibited or arrested in the event of any mechanical failure, such as would occur if one of hoist lines 28 and 29 broke, that removes the forces applied by hoist lines 28 and 29 to safety brake 62.

In the exemplary embodiment, balancing-side hoist line adjuster 58 may be inserted between balancing-side hoist line 29 and safety brake 62. In an alternative embodiment, balancing-side hoist line adjuster 58 may be inserted between balancing-side hoist line 29 and balancing-side retainer connector 42. In yet another alternative embodiment, balancing-side hoist line adjuster 58 may be inserted between any two components comprising the balancing-side drive mechanism. In still another embodiment, safety brake 62 may be mounted on a shaft passing perpendicular to and through driver-side retainer connector 40.

The operation of the invention allows for the up and down movement of the display assembly along the axis of and guided by guide tracks 12 and 13. To operate the invention when display face 8 is in any position, operator 16 applies power source 18 to input shaft 20. Power source 18 delivers a moment of force to input shaft 20 of such rotational speed and direction as is determined by operator 16. The force delivered to input shaft 20 may be conducted to gear reduction assembly 22 which conducts the force via output shaft 23 and drive wheel 24 to drive belt 26. Movement of hoist lines 28 and 29 is defined in an amount and direction by the rotation of drive wheel 24 and the corresponding movement of drive belt 26.

The movement of the display assembly is propelled by the force introduced by power source 18. This force is transmitted through gear reduction assembly 22, drive wheel 24, drive belt 26, hoist lines 28 and 29, and pulleys 30, 32, 34, 36, and 38. The force is conducted through the gear reduction assembly 22 and redirected perpendicularly to emerge horizontally from the gear reduction assembly 22 via output shaft 23 upon which is rigidly and concentrically mounted drive wheel 24, which in an exemplary embodiment is a metal sprocket with multiple teeth.

The limits of upward and downward motion of the entire display assembly, typically but not necessarily achieved by limiting the upward and downward motion of weight 50, may be established by an upper stop 52 and a lower stop 54, both of which may reside inside housing assembly 4. In an exemplary embodiment, stops 52 and 54 may be made of metal and rigidly attached to housing assembly 4 at upper and lower locations, respectively. In an exemplary embodiment, upper stop 52 may be attached to housing assembly 4 at a location that may be approximately adjacent to the top of housing assembly internal member 7. Also in the exemplary embodiment, lower stop 54 may be attached to housing assembly 4 at a location that may be approximately adjacent to the bottom of housing assembly internal member 7. In an alternative embodiment, stops 52 and 54 may be placed at other locations within housing assembly 4.

In another embodiment, stops 52 and 54 may be placed on the other side of housing assembly internal member 7 so that the limits of the up and down movement of the assembly may be controlled when display face retainer 6 contacts stops 52 and 54. In yet another alternative embodiment, stops 52 and 54 may be placed inside housing assembly 5 in order to limit the movement of balancing-side retainer connector 42. Limits on the motion of the display assembly also may be secured by incorporation of a torque-determined clutch mechanism within power source 18.

Figure 11:
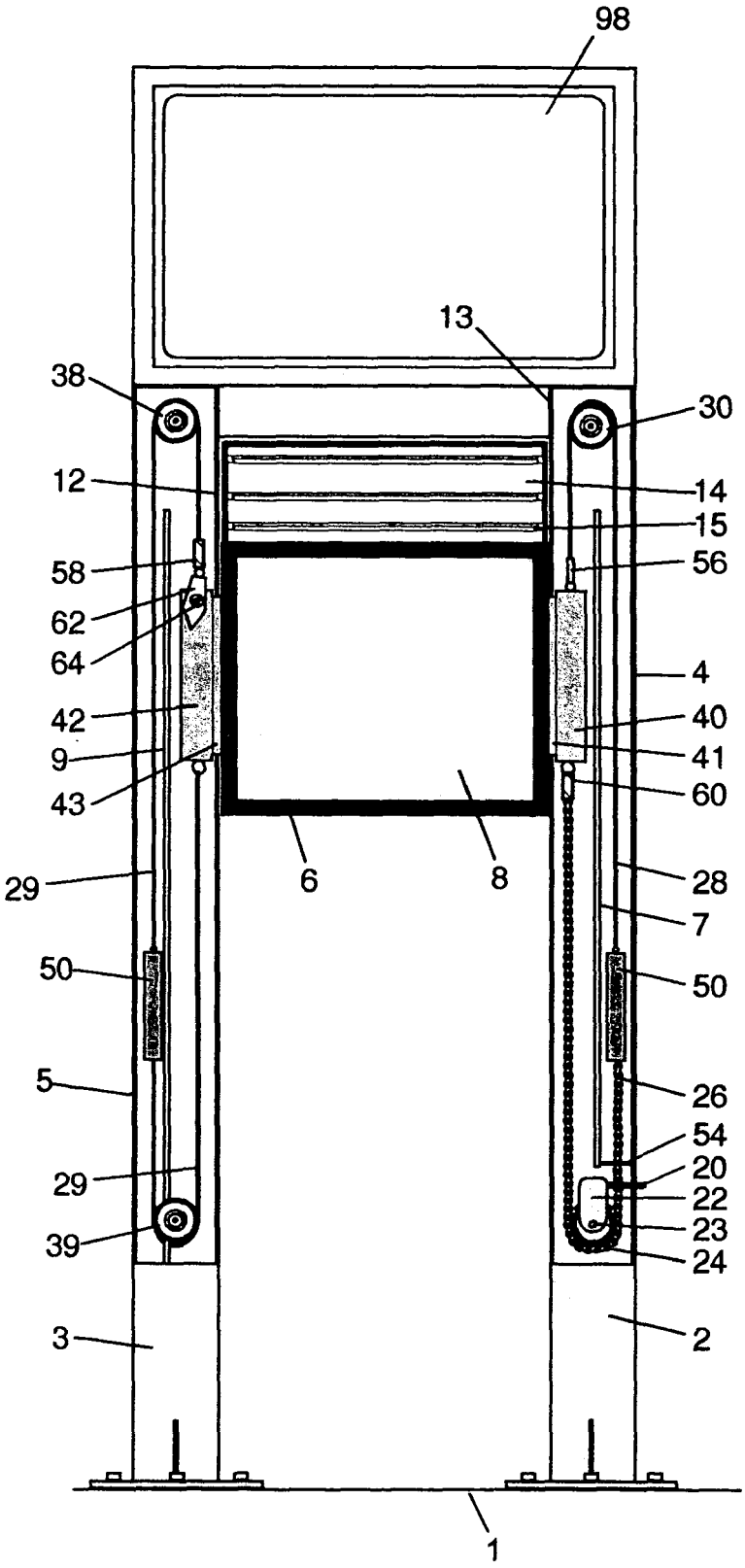
FIG. 11 is a front view of another exemplary embodiment of the system according to the present invention.

FIG. 11 is a front view of another exemplary embodiment of the system according to the present invention. As illustrated, the drive mechanism is somewhat simpler than the drive mechanism illustrated in FIGS. 2A and 2B. Specifically, the drive side contains a single pulley, namely drive-side lifting pulley 30, around which drive-side hoist line 28 runs. Neither balance-side hoist line 29 nor balance-side sending pulley 32 are present in the drive side of the drive mechanism. Balancing-side hoist line guide 34 is also unnecessary. With respect to the balancing side of the drive mechanism, a simple closed loop pulley system is illustrated in FIG. 11. Balancing-side hoist line 29 loops from one end of balancing-side retainer connector 42, around balancing-side lifting pulley 38, around balancing-side guiding pulley 39, and to the opposite end of balancing-side retainer connector 42.

Figure 3A:
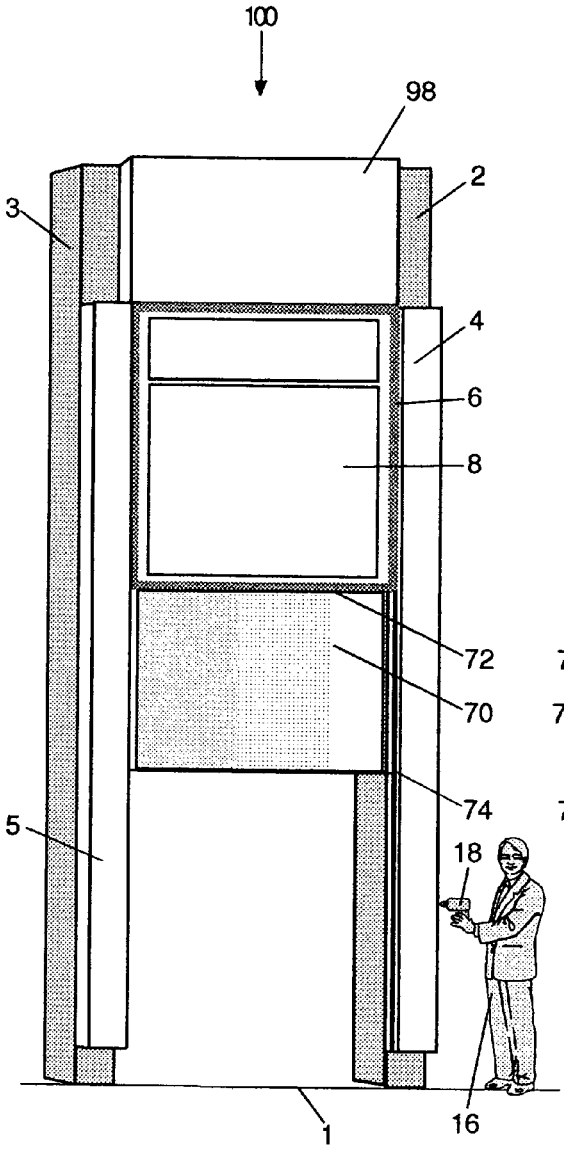
FIG. 3A is a perspective view of an alternative embodiment of the display, including an unfurled, hanging banner according to the present invention.
Figure 3B:
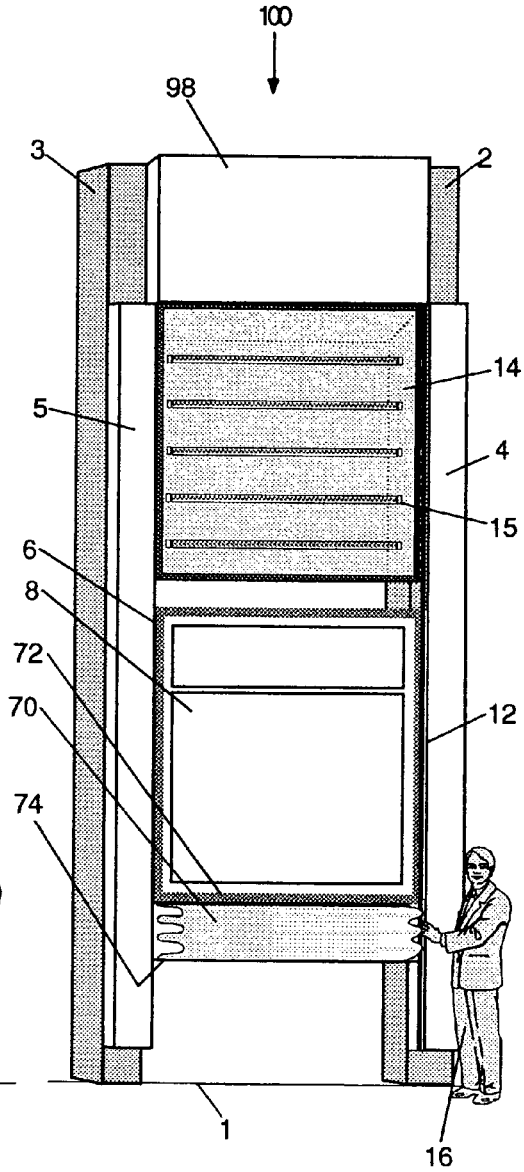
FIG. 3B is a perspective view of the embodiment of the display shown in FIG. 3B with the hanging banner furled and in a lower position.

FIGS. 3A and 3B show another alternative embodiment of the present invention. In this embodiment, the top of a flexible hanging banner 70 may be attached to the bottom of display face retainer 6 by an upper retainer bar 72 that is attached to the bottom of display face retainer 6. The top of hanging banner 70 is supported by upper retainer bar 72. In an exemplary embodiment, upper retainer bar 72 may be round. In an alternative embodiment, upper retainer bar may be a different shape. Upper retainer bar 72 may pass through a channel formed by a hem at the end of the fabric hanging banner 70. Thus, the end of banner 70 may be looped and hemmed. In an exemplary embodiment, upper retainer bar 72 may be pinched against the bottom of display face retainer 6 by a conventional window sash lock (not shown). In an alternative embodiment, retainer bar 72 may be coupled to the bottom of display face retainer 6 by any conventional hardware as would be known by a person of ordinary skill in the art.

The bottom of flexible banner 70 may be attached to a lower retainer bar 74. The bottom of banner 70 has a similar loop and hem containing lower retainer bar 74. Lower retainer bar 74 may be longer than upper retainer bar 72 and rides within guide tracks 12, 13 of housing assemblies 4, 5. That is, retainer bar 74 slides in guide tracks 12 and 13. Flexible banner 70 may move in an upward and downward direction along with the upward and downward movement of display face retainer 6. When display face retainer 6 is in an uppermost position, as shown in FIG. 3A, flexible banner 70 may be completely opened. When display face retainer 6 is in a lowermost position, as shown in FIG. 3B, flexible banner 70 may be brought to the bottom of the structure and can be changed by operator 16. Operator 16 may easily remove banner 70, for example, by twisting the sash lock.

FIG. 2B shows an alternative embodiment of the invention in which the elements of the invention may be mounted on two opposite sides of support pole 2, thereby creating a unit with display messages 10 that may face in two different directions. In the alternative embodiment, each side of support pole 2 has a complete set of components. This alternative embodiment may also include two complete sets of components on each side of support pole 3. When support poles 2 and 3 each have a complete set of components, a display face on one side may be raised and lowered independent of the display face on the other side.

It will be understood by those skilled in the art that this invention may be used for display signs having more than two sides. For example, in another embodiment, three systems may be employed for sign structures having three display faces 8. Therefore, it will be understood that the number of systems that may be installed at a display location may depend upon the number of display faces 8 at the structure. When there are more than two display faces 8, each display face 8 may be moveable independently of any other display face 8 by installation and use of a complete set of components for each display face 8.

Figure 4A:
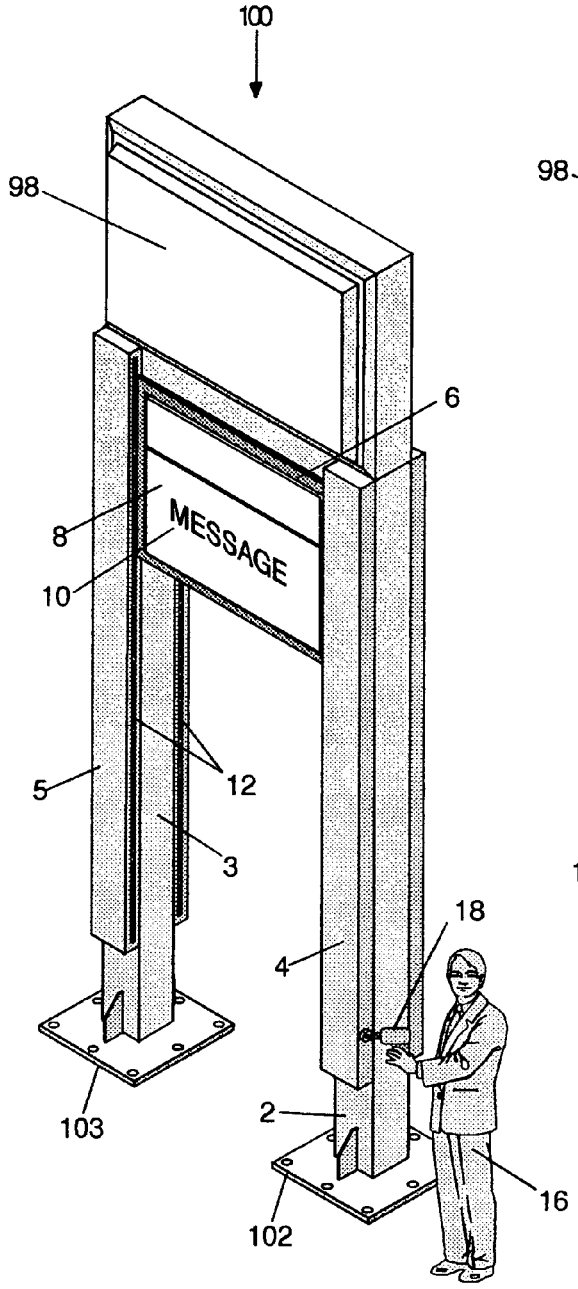
FIG. 4A is a perspective view of an alternative embodiment of the display, showing two display faces in upper positions, according to the present invention.
Figure 4B:
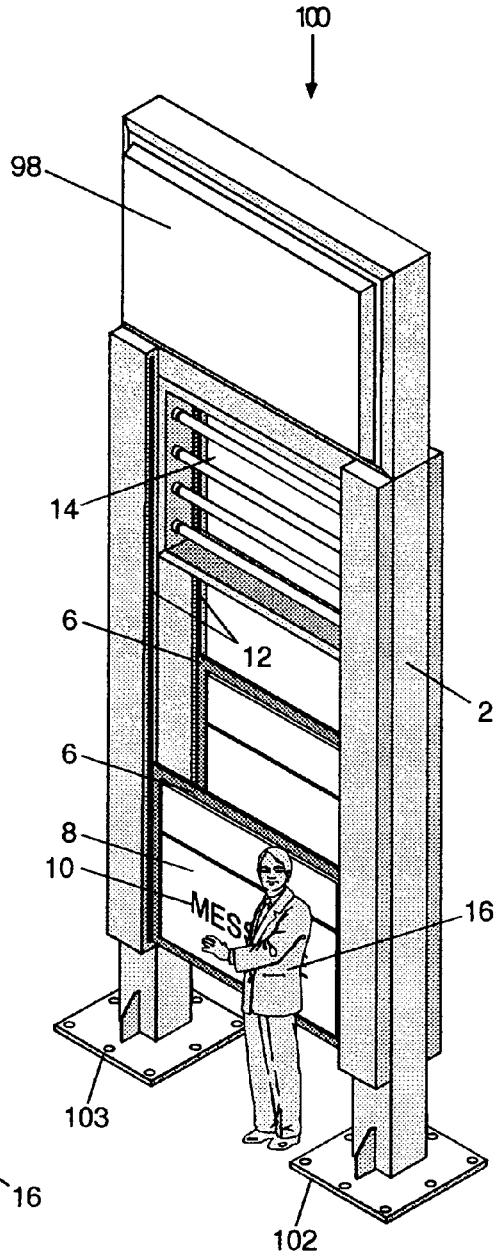
FIG. 4B is a perspective view of the embodiment of the display shown in FIG. 4A, showing the two display faces in lower positions.

FIGS. 4A and 4B show an alternative embodiment of the invention. In this embodiment, a fixed sign 98 is shown on top of support poles 2 and 3. FIG. 4B is a perspective view of the embodiment having two display faces 8 and shows each of the two display faces 8 in a lowered position. In contrast, FIG. 4A shows display faces 8 in an upper position. It will be understood that the fixed sign 98 in the alternative embodiment shown in FIGS. 4A and 4B may be on top of support poles 2 and 3, or may be in a different location. FIGS. 4A and 4B also show bases 102 and 103 for affixing support poles 2 and 3, respectively, to a surface such as a driveway.

Figure 5A:
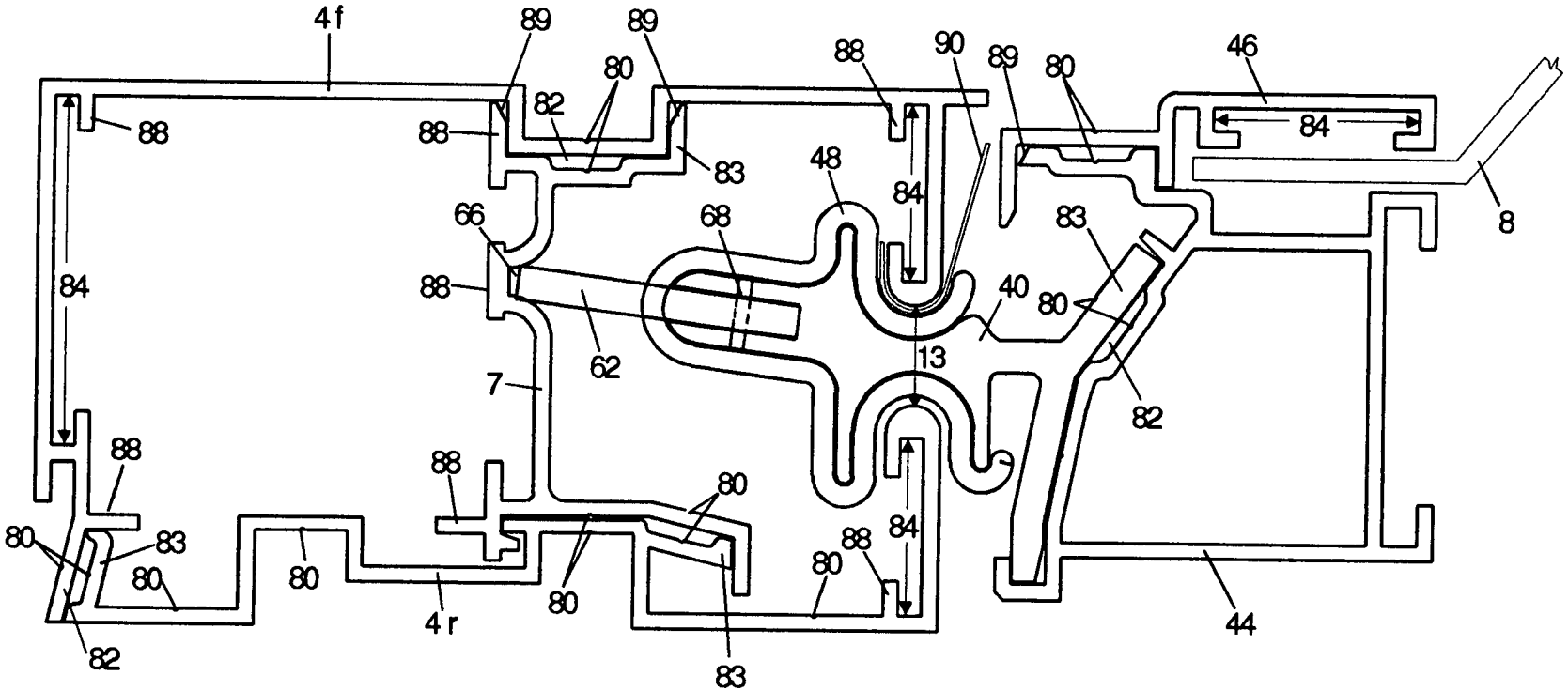
FIG. 5A is a top, cross-sectional view of the assembled components illustrating common features throughout the structure of the present invention.
Figure 5B:
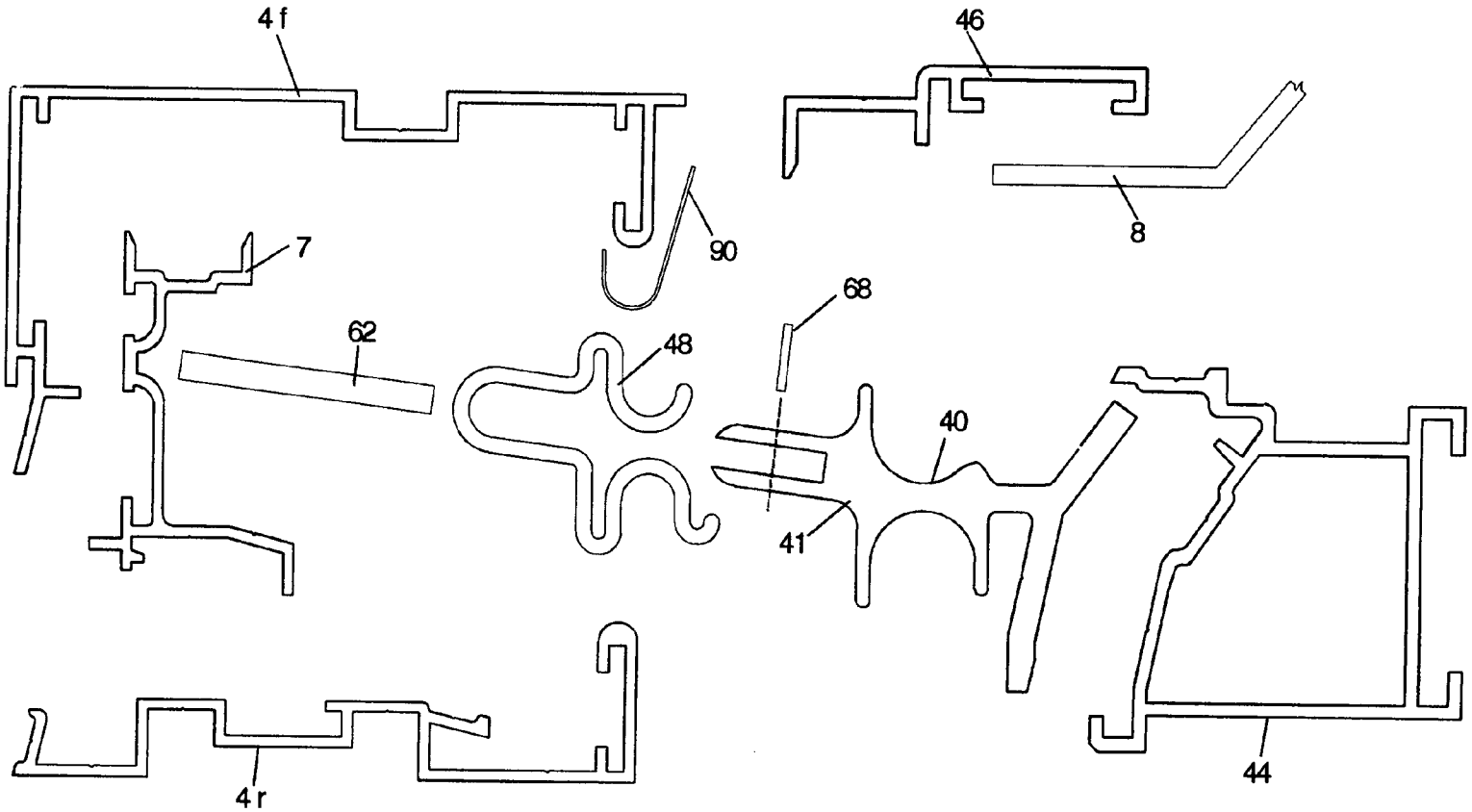
FIG. 5B is a top, cross-sectional view of the components of FIG. 5A shown in a disassembled state.

FIG. 5A is a top, cross-sectional view of assembled components illustrating common features throughout the invention. FIG. 5B is a top, cross-sectional view of the components of FIG. 5A shown in a disassembled state. The main components shown in FIGS. 5A and 5B include the front portion 4*f* and rear portion 4*r* of housing assembly 4 (similar portions would characterize housing assembly 5). Housing assembly internal member 7, drive-side retainer connector 40 (balancing-side retainer connector 42 would appear similarly), and safety brake 62 are illustrated. Note that safety brake 62 may be provided within housing assembly 4, housing assembly 5, or both housing assemblies 4 and 5. A display retainer body 44 and a display retainer cap 46 comprise display face retainer 6.

A display connector guide 48 is illustrated, which can be used with retainer connectors 40, 42. Display connector guide 48 is preferably a plastic component that controls movement of and reduces friction between mating components. Alternate approaches are possible to achieve the function of guiding the movement of display retainer connectors 40, 42 within guide tracks 12, 13. For example, roller wheels might be positioned on the ends of retainer connectors 40, 42. Such roller wheels would run within a channel created within housing assemblies 4, 5.

Finally, a flexible, U-shaped temporary alignment positioner 90 is illustrated in FIG. 5A. Precise, parallel mounting of the assemblies of the present invention facilitates the proper performance of guide tracks 12 and 13. Accurate placement of the assemblies during construction of the present invention is assured by a system of temporary alignment positioners 90 and slotted screw holes (not shown). Positioners 90 are inserted between display connector guide 48 and the limits of guide tracks 12, 13 as defined by housing assemblies 4, 5.

In addition to the main components, FIG. 5A also illustrates a number of features of those main components. Reference number 80 designates scribe lines or notches which provide for the location and easy application of fasteners 92 to affix the various components together. In an exemplary embodiment, fasteners 92 may be self-tapping machine screws. In an alternative embodiment, a different kind of fastener (e.g., rivets, bolts, and the like) may be used. Reference number 83 designates fastening arms that ensure simple and accurate orientation of the fastened assembly components. Reference number 82 designates bur chambers which receive metal burs from the self-tapping screws and prevent the burs from forcefully displacing components.

Reference number 84 in FIG. 5A designates channels for extension keys. The extension keys receive rectangular metal connectors to allow the joining of multiple lengths of housing and display components, thereby allowing for the safe and convenient transport, handling, and assembly of the invention on site. Channels 84 also facilitate the assembly of the structure of the present invention to heights in excess of 100 feet.

Reference number 86 designates a weight chamber. Weight chamber 86 is a continuous, unobstructed, enclosed, vertical cavity within housing assembly 4 that allows for the free vertical travel of weight 50. Reference number 88 designates weight guides that define the limits of horizontal movement of weight 50 within weight chamber 86. Reference number 89 identifies bevels on various components which are useful to facilitate insertion of one component within another.

Figure 5C:
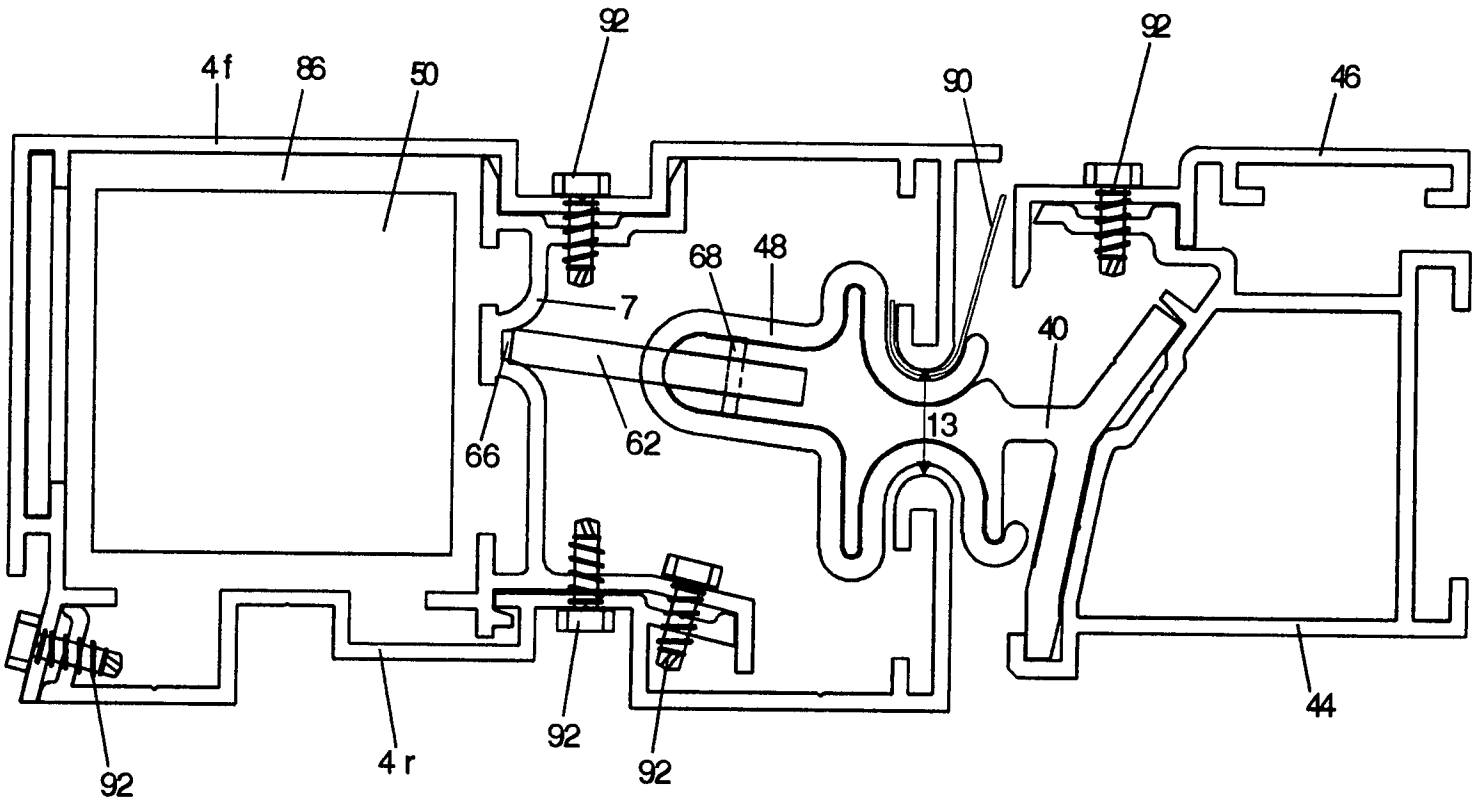
FIG. 5C is a top, cross-sectional view of the assembled components, like FIG. 5A, showing the interaction of various additional components that comprise the present invention.

Like FIG. 5A, FIG. 5C is a top, cross-sectional view of the assembled components. Taken together, FIGS. 5A, 5B, and 5C show the interaction of various components that comprise the present invention. FIG. 5C includes weight 50 and illustrates fasteners 92. Because display face 8 has a rectangular shape, each side of display face 8 contains a display retainer body 44 and a display retainer clip 46.

Figure 6:
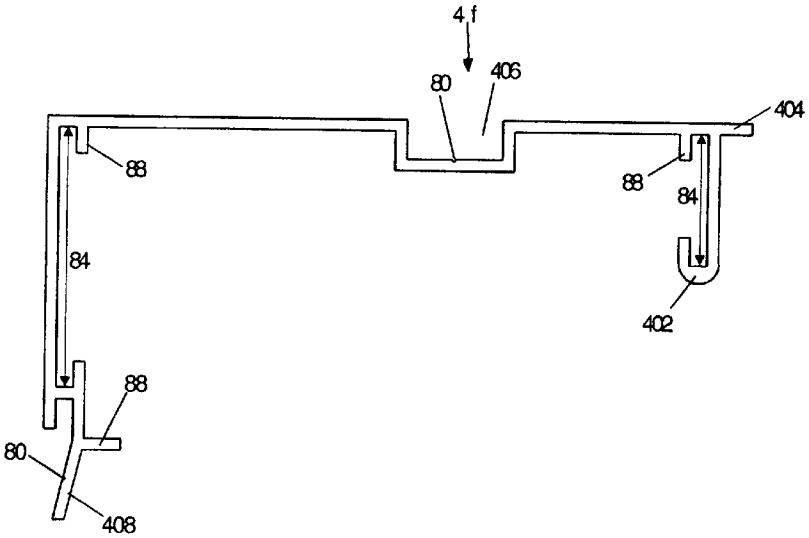
FIG. 6 is a cross-section of the front portion of the housing assembly according to the present invention.

FIG. 6 is a cross-section highlighting front portion 4*f* of housing assembly 4 (housing assembly 5 has a similar front portion). Front portion 4*f* has an outside radius 402 that limits movement of display connector guide 48. An extension tab 404 minimizes the width of the opening between housing assembly 4 and the display assembly to minimize the exposure of internal structures to weather elements and to minimize the leakage of light from display body 14. A recessed cavity 406 eliminates the projection of assembly fasteners, such as fasteners 92, beyond the front surface of housing assembly 4. A recessed and angled fastening arm 408 eliminates the projection of assembly fasteners beyond the side surface of housing assembly 4 and facilitates tool access to the fasteners in instances when housing assembly 4 is mounted on a broad, flat surface.

Figure 7:
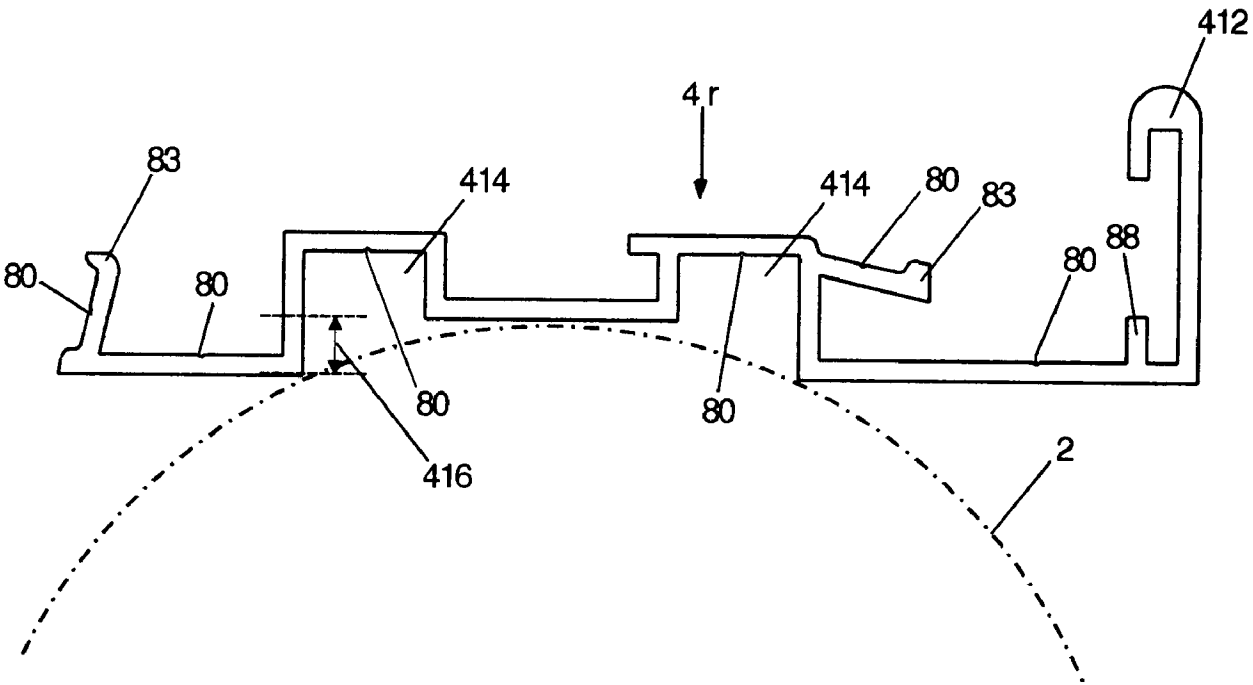
FIG. 7 is a cross-section of the rear portion of the housing assembly according to the present invention.

FIG. 7 is a cross-section highlighting rear portion 4*r* of housing assembly 4 (housing assembly 5 has a similar rear portion). Rear portion 4*r* has an outside radius 412 that limits movement of display connector guide 48. U-shaped channels 414 define internal contours that prevent rotation of square-head mounting fasteners for gear reduction assembly 22 and the various pulley mounts. A recessed portion 416 of rear portion 4*r* facilitates optimal contact when housing assembly 4 is optionally mounted to a round support pole, such as support pole 2. An exemplary embodiment of the invention uses a square or a rectangular pole 2.

Figure 8:
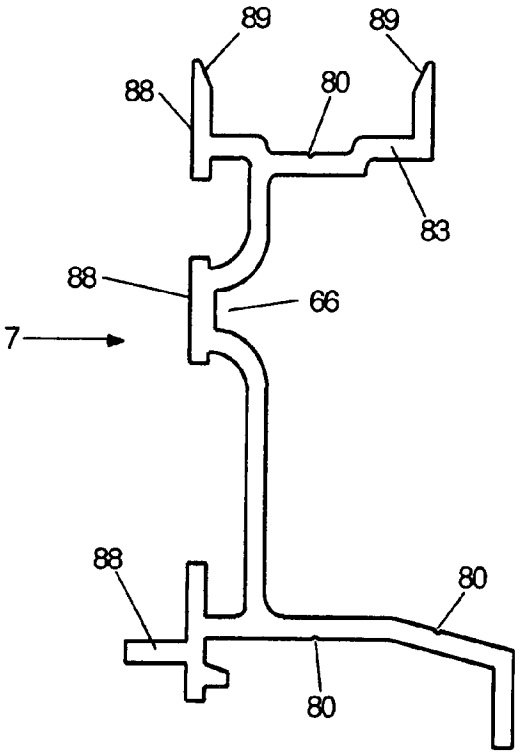
FIG. 8 is a cross-section of the internal member of the housing assembly according to the present invention.

FIG. 8 is a cross-section highlighting housing assembly internal member 7. Housing assembly internal member 9 could be similarly illustrated. FIG. 8 shows the radius walled locking groove that is designed to receive safety brake 62.

Figure 9B:
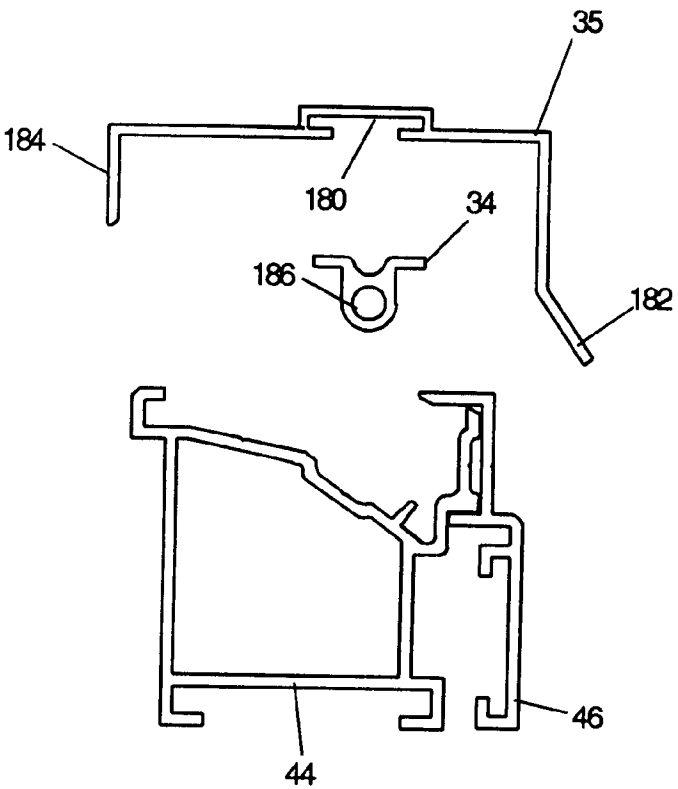
FIG. 9B is a top, cross-sectional view of the components of FIG. 9A shown in a disassembled state.
Figure 9A:
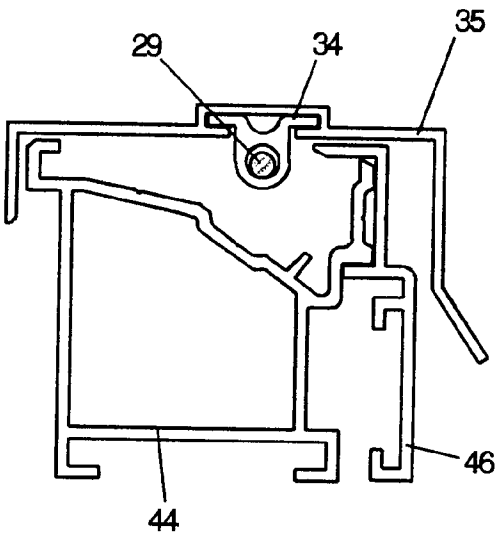
FIG. 9A is a top, cross-sectional view of the assembled components illustrating a flashing cap and a cable guide for the display face.

FIG. 9A is a top, cross-sectional view of the assembled components illustrating flashing cap 35 and balancing-side hoist line guide 34 for display face 8. Because display face 8 has a rectangular shape, each side of display face 8 contains a display retainer body 44 and a display retainer clip 46. When the display assembly is raised, the top of the rectangle tucks into flashing cap 35. In an exemplary embodiment, flashing cap 35 may be made of metal. Embedded within flashing cap 35 is balancing-side hoist line guide 34. Balancing-side hoist line guide 34 guides balancing-side hoist line 29 from one housing assembly 4 to the other housing assembly 5 above and away from display face 8. In an exemplary embodiment, balancing-side hoist line guide 34 may be made of a low-friction plastic.

FIG. 9B is a top, cross-sectional view of the components of FIG. 9A shown in a disassembled state. Additional details of flashing cap 35 and balancing-side hoist line guide 34 are illustrated. Balancing-side hoist line guide 34 has a cable cavity 186 for receiving balancing-side hoist line 29. Flashing cap 35 has an angle 182 that directs the display face assembly into flashing cap 35. Angle 182 may also direct rain and other elements away from the display face assembly, providing protection from inclement weather. A U-shaped sleeve 180 in flashing cap 35 receives balancing-side hoist line guide 34. A back guide 184 limits the rearward movement of the display face assembly.

The invention may be retrofitted to an existing sign. Alternatively, the invention may be installed with a new sign. When the invention is used to retrofit an existing sign, a pair of pre-manufactured assemblies (one drive side and one balancing side) may be attached to the surface of existing sign structures having two substantially parallel supporting columns. It is preferred that the pre-existing supporting columns be substantially parallel because substantially parallel mounting of the assemblies will provide better performance of the guide tracks than if the pre-existing supporting columns are not substantially parallel. Accurate placement of the assemblies on pre-existing supporting columns may be assisted by a system of temporary alignment positioners 90 and slotted screw holes (not shown) as discussed above. Alternatively, the invention may be retrofitted to an existing sign having a single support column; the drive side and balancing side assemblies may be attached to the opposing surfaces of the existing column.

Figure 10A:
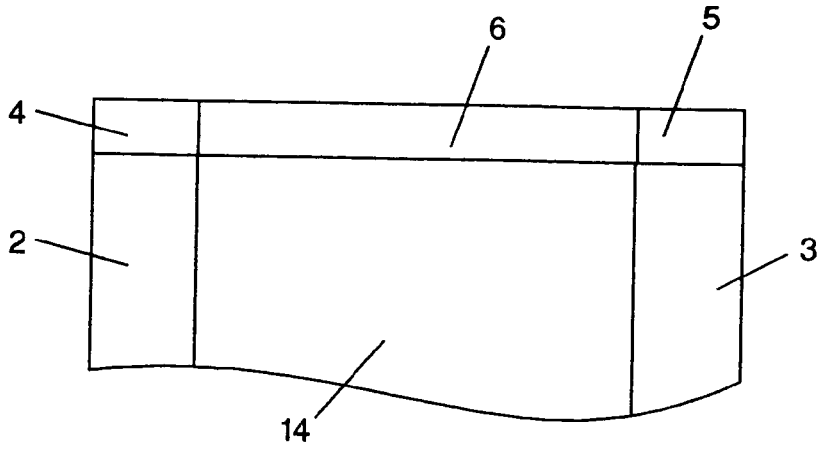
FIG. 10A is a top view of the components of the present invention retrofit to a preexisting sign display and support columns or poles for a situation in which the sign display and support columns happen to align.
Figure 10B:
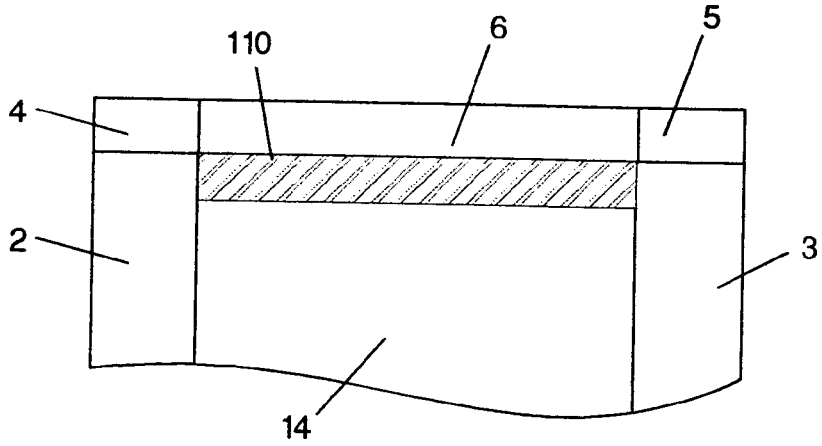
FIG. 10B is a top view of the components of the present invention, including a strip of flashing to facilitate a retrofit to a preexisting sign display and support columns or poles for a situation in which the preexisting sign display is narrower than the preexisting support columns.
Figure 10C:
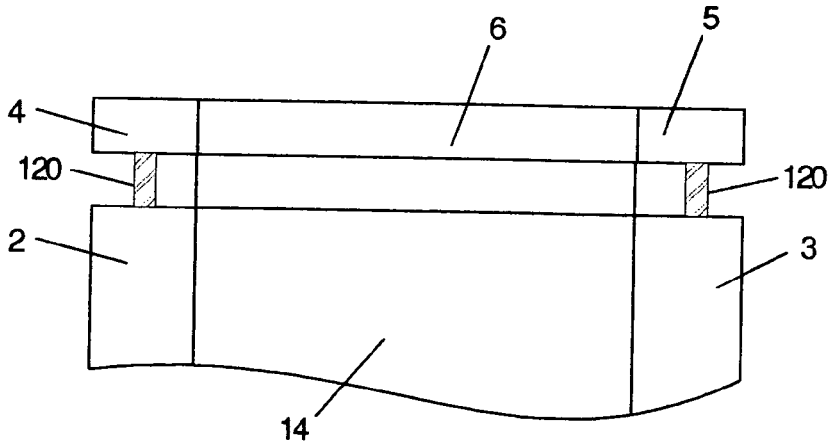
FIG. 10C is a top view of the components of the present invention, including a spacer to facilitate a retrofit to a preexisting sign display and support columns or poles for a situation in which the preexisting sign display is wider than the preexisting support columns.

FIGS. 10A, 10B, and 10C illustrate components useful in retrofitting the assembly of the present invention to existing sign structures. For example, a pre-manufactured assembly according to the present invention may be attached to the surface of an existing sign having two parallel support columns (or poles). FIG. 10A illustrates preexisting sign display body 14 to which display face retainer 6 (which retains display face 8) is mounted flush to the surface of display body 14. Preexisting support poles 2, 3 are disposed on opposite sides of display body 14. Because preexisting sign display body 14 happens to lie in the same plane as preexisting support poles 2 and 3, housing assemblies 4 and 5 of the present invention can be mounted directly to preexisting support poles 2 and 3, respectively, without the need for additional compensating structure.

Such retrofit applications may have to address dimensional differences, however, between the components of the assembly and the preexisting sign structure. FIG. 10B illustrates the situation in which preexisting sign display body 14 is narrower than preexisting support poles 2 and 3. In this situation, the invention includes a strip 110 of flashing disposed on the surface of display body 14. Strip 110 is sized so that the combination of display body 14 and strip 110 has about the same width as preexisting support poles 2 and 3. The compensating structure of strip 110 permits display face retainer 6 to be mounted flush to the surface of strip 110 and, therefore, to display body 14. Strip 110 also prevents leakage of light from the illumination source of display body 14 and the risk of adverse consequences caused by inclement weather should wind, rain, snow, and the like have access to an open display body 14, the two sides of display face 8, or both.

FIG. 10C illustrates the situation in which preexisting sign display body 14 is wider than preexisting support poles 2 and 3. In this situation, the invention includes a spacer 120 disposed between the preexisting support poles 2 and 3 and housing assemblies 4 and 5 of the present invention. Spacer 120 is sized so that the combination of preexisting support poles 2 and 3 and spacer 120 has about the same width as preexisting sign display body 14. The compensating structure of spacer 120 permits display face retainer 6 to be mounted flush to the surface of spacer 120 and, therefore, to display body 14. Spacer 120 also prevents abutment of components as display face retainer 6 and display face 8 are raised into position, thereby allowing display face retainer 6 and display face 8 to attain their uppermost position. It should be noted that, in some embodiments, there is no need for display face retainer 6; display face 8 is sufficiently sturdy to render display face retainer 6 unnecessary.

When the invention is used to install a new sign, a pair of assemblies (that is, a drive-side assembly and a balancing-side assembly) may be attached to the surface of any pair of substantially parallel supporting structures. In an alternative embodiment, the supporting structures may comprise housing assemblies 4, 5 and have hollow elements which contain the components of the assemblies. In other words, housing assemblies 4, 5 may be sufficiently robust to become the supporting poles themselves, thereby eliminating the need for separate poles 2, 3. Alternatively, poles 2 and 3 may be integrally formed with housing assemblies 4 and 5, respectively, thereby creating integral, one-piece, monolithic structures. In an exemplary embodiment, housing assemblies 4, 5 may be used with smaller signs.

The exemplary embodiment incorporates a pair of parallel poles 2, 3 as the supporting structure. In an alternative embodiment, however, the supporting structure may be a flat wall upon which housing assemblies 4, 5 may be mounted directly without the need for poles 2, 3. In a further alternative embodiment, the supporting structure may be a single pole or supporting column upon which housing assemblies 4, 5 may be mounted.

For both new and retrofit uses of the present invention, a previously existing sign or display face 8 may be used; for example, a sign that is already at the site or otherwise available may be accommodated. Alternatively, a new display face 8 may be fabricated. Whatever the source of display face 8, the surface of display face 8 may have tracks to hold changeable alphanumeric characters (sometimes called "drop-in" letters and numbers). In an alternative embodiment, the entire display face 8 may be easily changeable using a variety of alternative systems. Two examples of this alternative embodiment are (a) a flexible (typically vinyl) substrate with a removable adhesive, or (b) a clip-on retaining frame which may be attached to the sign face.

Operator 16 can lower display face 8, change message 10, and raise display face 8 safely, in a matter of a few minutes, with the application of little skill or effort. Message 10 is neater and more detailed than for existing signs. This advantage is of particular significance with the rapid evolution of low-cost, large-scale digital printing. The era of cut-and-applied vinyl letters and graphics as the staple medium of the commercial sign industry is only a few years from extinction. Easily changeable, high-resolution, full-color graphics are just now being introduced. It is not unusual today for businesses to leave signs unchanged for years, sometimes even decades. Future signs will be re-imaged frequently, however, with photo-quality messages 10, on a weekly or daily basis. Business segments, which have not traditionally used changeable graphics, may now do so with increased utility, simplicity, and economy. The present invention accommodates and facilitates these major shifts in the sign industry.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention.

What is claimed:

1. A sign display apparatus engaging a sign support, the sign display apparatus comprising:

a moveable display face for displaying information;

a stationary display body having a source of illumination for illuminating the display face when the display face is in a position covering entirely the display body; and a drive mechanism coupled to the display face for moving the display face away from the stationary display body and its source of illumination.

2. A sign display apparatus engaging a sign support, the sign display apparatus comprising:

a moveable display face for displaying information;

a stationary display body having a source of illumination for illuminating the display face when the display face is in a position over the display body;

a drive mechanism coupled to the display face for moving the display face relative to the stationary display body and its source of illumination; and first and second parallel guide tracks on respective opposite sides of the display face into which is disposed the display face, thereby defining a plane of travel as the display face is moved.

3. The sign display apparatus of claim 1, further comprising a second display face for displaying information, the second display face being coupled to the first display face and being movable concurrently with the first display face.

4. The sign display apparatus of claim 2, further comprising first and second guide tabs protruding through respective ones of the first and second parallel guide tracks and coupled to the display face, wherein the drive mechanism includes at least one cable coupled to at least one of the first and second guide tabs.

5. A sign display apparatus engaging a sign support, the sign display apparatus comprising:

a moveable display face for displaying information;

a stationary display body having a source of illumination for illuminating the display face when the display face is in a position over the display body; and a drive mechanism coupled to the display face for moving the display face relative to the stationary display body and its source of illumination, wherein the drive mechanism includes a first cable and a second cable coupled to respective first and second sides of the display face.

6. The sign display apparatus of claim 5, further comprising a weight disposed within a cavity of the sign support, the weight being coupled to the first cable and the second cable.

7. The sign display apparatus of claim 5, wherein the drive mechanism includes a gear reduction assembly coupled to the first cable and the second cable.

8. The sign display apparatus of claim 5, wherein the drive mechanism includes a power source coupled to the first cable and the second cable.

9. The sign display apparatus of claim 8, wherein the power source is selected from the group consisting of a power unit, a rechargeable power unit, a removable crank, and a removable hand crank.

10. A sign display apparatus engaging a sign support, the sign display apparatus comprising:

a moveable display face for displaying information;

a stationary display body having a source of illumination for illuminating the display face when the display face is in a position over the display body;

a drive mechanism coupled to the display face for moving the display face relative to the stationary display body and its source of illumination; and a brake disposed within a cavity of the sign support for inhibiting movement of the display face.

11. An apparatus for lowering a moveable display face to change a message displayed on the display face and for raising the moveable display face to a visible position, the apparatus comprising:

first and second housing assemblies affixed in a spaced relationship, each housing assembly having:

(a) an outside surface defining an internal cavity, and (b) a guide track extending along at least a portion of the outside surface of the housing assembly such that, in combination, the housing assemblies provide a pair of substantially parallel guide tracks into which is disposed the display face, thereby defining a plane of travel as the display face is lowered and raised; and a drive mechanism located within the cavities of the first and second housing assemblies and coupled to the display face for moving the display face in the guide tracks and relative to the housing assemblies.

12. The apparatus of claim 11, wherein the drive mechanism includes at least one line attached to the display face to which force is applied or released to move the display face.

13. The apparatus of claim 12, wherein the drive mechanism further includes one or more of gears, speed reducers, belts, springs, and pulleys.

14. The apparatus of claim 13, wherein the drive mechanism further includes a counterweight reducing the force required to move the display face.

15. The apparatus of claim 11, wherein the drive mechanism further includes a power source providing the power to operate the drive mechanism at a safe distance from the plane of travel of the display face.

16. The apparatus of claim 11, further comprising a brake coupled to the drive mechanism for stopping inadvertent movement of the display face upon mechanical failure.

17. The apparatus of claim 11, further comprising a stationary sign displaying information.

18. The apparatus of claim 11, further comprising a pair of stops preventing the display face from traveling beyond limits defined by the location of the stops.

19. The apparatus of claim 11, further comprising a second moveable display face, wherein:

(a) the first and second housing assemblies each have a pair of guide tracks extending along at least a portion of the outside surface of the housing assembly such that, in combination, the housing assemblies provide two pair of substantially parallel guide tracks into each pair of which is disposed one of the two display faces, thereby defining two offset and parallel planes of travel as the display faces are independently raised and lowered; and (b) the drive mechanism is coupled to each of the display faces for independently moving the display faces in their respective guide tracks and relative to the housing assemblies.

20. A kit for lowering a moveable display face to change a message displayed on the display face and for raising the moveable display face to a visible position covering a stationary display body having a source of illumination for illuminating the display face when the display face is in position over the display body, the kit comprising:

first and second housing assemblies adapted to be affixed to a support structure in a spaced relationship, each housing assembly having:

(a) an outside surface defining an internal cavity, and (b) a guide track extending along at least a portion of the outside surface of the housing assembly such that, in combination, the housing assemblies provide a pair of substantially parallel guide tracks into which is disposed the display face, thereby defining a plane of travel as the display face is lowered and raised; and a drive mechanism located within the cavities of the first and second housing assemblies and coupled to the display face for moving the display face in the guide tracks and relative to the housing assemblies.

21. The kit of claim 20, wherein the drive mechanism includes at least one line attached to the display face to which force is applied or released to move the display face.

22. The kit of claim 21, wherein the drive mechanism further includes one or more of gears, speed reducers, belts, springs, and pulleys.

23. The kit of claim 22, wherein the drive mechanism further includes a counterweight reducing the force required to move the display face.

24. The kit of claim 20, wherein the drive mechanism further includes a power source providing the power to operate the drive mechanism at a safe distance from the plane of travel of the display face.

25. The kit of claim 20, further comprising a brake coupled to the drive mechanism for stopping inadvertent movement of the display face upon mechanical failure.

26. The kit of claim 20, further comprising a pair of stops preventing the display face from traveling beyond limits defined by the location of the stops.

27. The kit of claim 20, further comprising a strip of flashing disposed on the surface of the display body to prevent leakage of light from the illumination source of the display body and the risk of adverse consequences caused by inclement weather.

28. The kit of claim 20, further comprising a spacer engaging the housing assemblies so that the display face can be mounted flush against the surface of the spacer and the display body.

* * * * *